US008186656B2

(12) United States Patent
Fujii et al.

(10) Patent No.: US 8,186,656 B2
(45) Date of Patent: May 29, 2012

(54) SAUNA DEVICE

(75) Inventors: Satoshi Fujii, Aichi (JP); Masayosi Toujyou, Aichi (JP); Shigeru Morikawa, Aichi (JP); Naoya Araki, Aichi (JP); Yasuaki Shima, Aichi (JP); Daisuke Ogawa, Aichi (JP); Masahiro Fujita, Gifu (JP); Seiji Mizuno, Aichi (JP); Daisuke Tsubosa, Aichi (JP); Yasuhiro Suzuki, Aichi (JP); Yoshio Ikari, Aichi (JP); Hideyuki Fujisawa, Aichi (JP)

(73) Assignee: Panasonic Corporation, Osaka (JP)

( * ) Notice: Subject to any disclaimer, the term of this patent is extended or adjusted under 35 U.S.C. 154(b) by 487 days.

(21) Appl. No.: 12/445,512

(22) PCT Filed: Oct. 17, 2007

(86) PCT No.: PCT/JP2007/070238

§ 371 (c)(1),
(2), (4) Date: Apr. 14, 2009

(87) PCT Pub. No.: WO2008/050647

PCT Pub. Date: May 2, 2008

(65) Prior Publication Data

US 2010/0024117 A1 Feb. 4, 2010

(30) Foreign Application Priority Data

Oct. 23, 2006 (JP) ..... 2006-287286
Dec. 4, 2006 (JP) ..... 2006-326623
Jan. 23, 2007 (JP) ..... 2007-012308

(51) Int. Cl.
*B01F 3/04* (2006.01)

(52) U.S. Cl. ..... 261/127; 261/28; 261/142; 4/524

(58) Field of Classification Search ..... 261/28, 261/115, 127, 137, 142; 4/524
See application file for complete search history.

(56) References Cited

U.S. PATENT DOCUMENTS 4,520,864 A * 6/1985 Katagiri et al. ..... 165/60
(Continued)

FOREIGN PATENT DOCUMENTS

JP 2-88641 7/1990
(Continued)

OTHER PUBLICATIONS

International Search Report of PCT Application No. PCT/JP2007/070238 dated Feb. 5, 2008.

*Primary Examiner* — Charles Bushey
(74) *Attorney, Agent, or Firm* — Panasonic Patent Center; Dhiren Odedra; Kerry Culpepper

(57) ABSTRACT

To provide a sauna device having a small number of components without any special heat source, operable at a low running cost, and capable of turning a sauna room into a high humidity space with low noise. The sauna device has a heating/humidifying unit for heating/humidifying air, a ventilating unit for exhausting the air in the sauna room, and a control unit for controlling the heating/humidifying unit and the ventilating unit. The heating/humidifying unit has a heating section for heating the air through a circulation blowing section for circulating the air in the sauna room and a humidifying section for humidifying the heated air having passed through the heating section. The humidified air is blown out into the sauna room through the humidifying section. A bent portion where the air-blowing duct through which the humidified air having passed through the humidifying section passes is bent is provided.

24 Claims, 19 Drawing Sheets

U.S. PATENT DOCUMENTS

| | | | | |
|---|---|---|---|---|
| 4,833,739 | A * | 5/1989 | Sakakibara et al. | 4/524 |
| 5,037,585 | A * | 8/1991 | Alix et al. | 261/142 |
| 5,425,902 | A * | 6/1995 | Miller et al. | 261/128 |
| 5,950,254 | A * | 9/1999 | Yasue | 4/524 |
| 6,092,794 | A * | 7/2000 | Reens | 261/115 |
| 6,390,453 | B1 * | 5/2002 | Frederickson et al. | 261/26 |
| 7,308,723 | B2 * | 12/2007 | Nunokawa | 4/524 |
| 7,896,319 | B2 * | 3/2011 | Fujii et al. | 261/28 |
| 8,070,138 | B2 * | 12/2011 | Saitou et al. | 261/28 |
| 2009/0056009 | A1 | 3/2009 | Matsubara et al. | |

FOREIGN PATENT DOCUMENTS

| | | | |
|---|---|---|---|
| JP | 5-141725 | | 6/1993 |
| JP | 6-75488 | | 10/1994 |
| JP | 6-75488 | U | 10/1994 |
| JP | 9-56770 | | 3/1997 |
| JP | 2001-190631 | | 7/2001 |
| JP | 2003-207176 | | 7/2003 |
| JP | 2005-003343 | | 1/2005 |
| JP | 2005-21427 | | 1/2005 |
| JP | 2005-52287 | | 3/2005 |
| JP | 2005-278782 | | 10/2005 |
| JP | 2006-025967 | | 2/2006 |
| JP | 2006-25967 | | 2/2006 |
| JP | 2006-212246 | | 8/2006 |
| JP | 2006-288712 | | 10/2006 |

* cited by examiner

SAUNA DEVICE

TECHNICAL FIELD

The present invention relates to a sauna device used in order to turn a sauna room such as a bathroom into a sauna space under a moderate-high-temperature and high-humidity atmosphere.

BACKGROUND ART

Generally, mist device which is installed on the ceiling of a bathroom to turn the bathroom into a sauna room has been known as an exemplary type of a sauna device.

As for sauna, there is a dry sauna for making a high-temperature and low-humidity environment in which an inside temperature is about 100° C. and a relative humidity is about 10%, or a steam sauna for making a moderate-high-temperature and high humidity environment in which an inside temperature is about 40 to 50° C. and a relative humidity is about 70% or more. Recently, attention has been focused on a sauna device which is installed in a bathroom, a shower room, or the like thereby allowing the bathroom or the shower room itself to be used as a sauna room, and various steam sauna devices have been proposed.

FIG. 25 is a main-part sectional view schematically illustrating an inner structure according to an example of a known sauna device.

As shown in FIG. 25, a sauna device includes blower device 105, which is installed on ceiling 101 of a bathroom, and is adapted to take air within the bathroom from air inlet 103 by use of blower fan 102 and send the air to the inside of the bathroom from blowing port 104. The sauna device also includes steam generating device 108, which is provided on blower device 105, and is adapted to allow steam heater 107 to generate steam by heating water supplied via water-supply pipe 106 and eject the steam from nozzle 109 in the bathroom. As for documentary information of the related art, for example, Patent Document 1 has been known.

In the known sauna device, since there is used a method of performing humidification by allowing steam heater 107 to heat water, water at room temperature is heated from room temperature to a certain temperature, and is vaporized and humidified by being injected from nozzle 109. However, in order to turn a space within the bathroom into a moderate-high-temperature sauna space of a temperature of 40 to 50° C. and a relative humidity of 70 to 100%, it is required that the hot water to be injected from nozzle 109 have a temperature of 50° C. or more. Since there is used a method of direct injection from nozzle 109 into the bathroom, in order for a sauna user to take a sauna without an uncomfortable feeling, an injection temperature of 50 to 70° C. is preferable for bodily sensation though the bodily sensation also depends on the temperature in the bathroom at that time, and it is also required that the hot water to be injected have a temperature of 50° C. or more even in view of bodily sensation. Accordingly, a large heat amount is required to heat water at room temperature to the temperature of 50 to 60° C., and a huge amount of energy is required to be supplied. Specifically, a large amount of electricity is required to heat water by use of steam heater 107, and construction for treating high current should be performed. In order to increase the inside temperature of the bathroom by use of only the hot water injected from nozzle 109, a huge amount of injection water is required, and as a result, more energy is required to be supplied.

In order to warm the inside of the bathroom effectively, another known sauna device shown in FIG. 26 is configured to be used in combination with hot-air heater 110. However, there are needed two heaters such as hot-air heater 110 for heating air and steam heater 107 for heating water, and thus a huge amount of energy is required to be supplied. As described above, in such known devices, water is turned into hot water by using electricity when a special heat source such as a water heater is not used. Thus, there are problems that a large amount of energy is required for inputting and high running cost is required in order to drive the sauna device. Accordingly, it is required to reduce running cost, that is, electric power consumption, or to shorten a time period until taking a bath after starting to drive the sauna device by early start.

There is also a problem that the device is undesirable in bodily sensation since the hot water ejected from nozzle 109 is directly sprayed into the bathroom and comes into contact with the sauna user's body.

Since droplets come into contact with the body, there is a problem that it is hard to read a book in the bathroom and it is hard to wash the user's body while driving the sauna device. Thus, it is required to provide a space free from restriction in action such as reading even in the sauna room.

FIG. 27 is a view illustrating an internal structure of a sauna device disclosed as a spray device, according to another example of such a known sauna device.

In the spray device of the known type, spray nozzle 201 is disposed in a fan duct in which an anterior end portion is bent in a spray direction and a spray orifice is formed on the anterior end. In the spray device for ejecting a spray liquid from spray nozzle 201 and blowing it from the spray orifice, there is known a configuration in which first air blowing port 202 is formed on an upper border of a spray orifice and second air blowing port 203 is formed on a lower border of the spray orifice so as to blow air from the first and second air blowing port and eject spray liquid from the spray orifice.

As for documentary information of the related art, for example, Patent Document 2 has been known.

In the spray device disclosed in Patent Document 2, to bend a sound propagation direction and to provide a curved pipe on a blowing port are considered as means for reducing the spray noise. However, in the sauna device used in bathroom, not only the spray noise but also air-blower noise such as wind noise generated from a fan motor are echoed in the bathroom, thereby causing uncomfortable feeling.

When a user relaxes in the sauna space and reads a book with glasses, large humidified air particles easily adhere to the user's body, temperature humidity distribution is inappropriate, glasses are fogged, and dew condensation water drops on the book, thereby causing uncomfortable feeling.

At the time of drying clothes, drying marks may occur, thereby causing uncomfortable feeling.

FIG. 28 is a side sectional view illustrating a mist functional sauna device used in a bathroom, according to another example of such a known sauna device.

As shown in FIG. 28, such a type of the sauna device includes heated-air-blowing section 302 which blows air heated by heating section 301 for heating air, humidifying section 303, humidified-air-blowing section 304 which blows air humidified by the means of humidifying section 303, suction port 305, and blowing port 306. The sauna device is adapted to merge the heated air from heated-air-blowing section 302 with the humidified air from humidified-air-blowing section 304 just before blowing port 306, and blow the heated and humidified air from blowing port 306. The sauna device uses a configuration in which humidifying section 303 breaks up the hot water for humidification by contacting the hot water to a blade which is rotated by a motor. As for documentary information of the related art, for example, Patent Document 3 has been known.

In the known sauna device, heated-air-blowing section 302 and humidified-air-blowing section 304 are separated, and two air ducts are required. Since a large number of components are required, its structure becomes complicated, and its product weight becomes heavy. Thus, there are problems that maintenance is difficult and product cost is high, and so reduction in the number of components is required.

There is also a problem that the drive sound is noisy because of the motor sound and the sound generated when the blade breaks up water. Thus, reduction in drive sound is required.

FIGS. 29 and 30 are a side configuration view illustrating a bathroom heating/drying device as another example of such a known sauna device and a perspective view illustrating a circulation unit thereof, respectively.

The known bathroom heating/drying device is configured as shown in the drawing. In the device, circulation unit 311 is integrally formed of circulation motor 307, circulation blower fan 308, circulation component 309, and heat exchanger 310 using hot water to perform heating. The unit is mounted on external casing 312. Circulation part 315 has suction opening 313 and transpiration opening 314 formed on the lower side thereof. Circulation part 315 is provided with circulation-part partition plate 116 which separates suction opening 313 and transpiration opening 314. As for documentary information of the related art, for example, Patent Document 4 has been known.

This bathroom heating device is configured such that circulation unit 311 is disposed on the substantially center of the device, and is communicated with transpiration opening 314 through a substantially straight ventilation flue. Hence, the humidifying section should be provided in the ventilation flue when the mist function is added. However, there is a problem that to provide the humidifying section in the ventilation flue is difficult in view of space. Thus, it is required that installation of the humidifying section becomes easier.

[Patent Document 1] Japanese Patent Unexamined Publication No. 2003-207176

[Patent Document 2] Japanese Patent Unexamined Publication No. H02-233167

[Patent Document 3] Japanese Patent Unexamined Publication No. 2006-212246

[Patent Document 4] Japanese Patent Unexamined Publication No. 2005-3343

DISCLOSURE OF THE INVENTION

The present invention has been made in order to solve the problems mentioned above, and its object is to provide a sauna device capable of being driven with low energy consumption and at a low running cost without any special heat source such as a water heater for spraying hot water, and capable of blowing humidified air into the bathroom under a condition where a particle size of droplets in the humidified air blown from the sauna device is infinitesimal.

According to a first aspect of the invention, the sauna device is configured as follows in order to achieve the above-mentioned object. The sauna device includes: a heating/humidifying unit for heating/humidifying air; a ventilating unit for exhausting the air in the sauna room; and a control unit for controlling the heating/humidifying unit and the ventilating unit. The heating/humidifying unit has a heating section for heating the air through a circulation blowing section for circulating the air in the sauna room and a humidifying section for humidifying the heated air having passed through the heating section. The humidified air is blown out into the sauna room through the humidifying section. Specifically, since air heated by the heating section for heating air is humidified by the humidifying section, it is not necessary to heat water by use of hot water. Since the humidifying section is able to blow heated and humidified air from the blowing port to the sauna room without connecting a heat source such as a water heater for supplying hot water, construction becomes easy. Since it is not necessary to heat water, it is possible to provide a low-running-cost sauna device. As another means, a vapor-liquid separation unit for separating large droplets having a predetermined size or more and micro droplets is provided on the leeward of the water breakup portion. By use of this means, the sauna device having the following effect is obtained. The large droplets in the humidified air, in which large droplets and micro droplets entering into the vapor-liquid separation unit are mixed, are collected by impacting on a wall surface or an end face of the vapor-liquid separation unit. On the other hand, micro droplets pass through the wall surface or the end face of the vapor-liquid separation unit without impact, and the blown humidified air includes only micro droplets. Specifically, the inside of the sauna room can be turned into a clear (transparent) and high-humidity space by the humidified air containing the micro droplets blown from the sauna device. Therefore, it is possible to provide a sauna device which creates a sauna space having advantages that restriction in action caused by driving the sauna device is small while humid feeling is obtained, a user can read a book, and so on.

Next, it is another object of the invention to provide a sauna device free from uncomfortable feeling caused by spray noise and air-blower noise of a fan motor in use.

According to another aspect of the invention, the sauna device described in the first aspect is, in order to achieve the object mentioned above, additionally configured such that the air-blowing duct for passing the humidified air having passed through the humidifying section has a bent portion. Thereby, midfrequency sound is cut by the bent portion, and thus it is possible to supply low-noise heated and humidified air from the blowing port to the inside of the sauna room.

It is another object of the invention to provide a sauna device capable of achieving high temperature, high humidification, and low noise with a small number of components.

According to a second aspect of the invention, the sauna device is configured as follows in order to achieve the above-mentioned object. The sauna device includes: a circulation blowing unit for circulating air in a bathroom; an air heating unit for heating air; a humidifying unit for humidifying air; and a ventilation flue for blowing air, which have passed through the air heating unit, from a blowing port through the humidifying unit to a sauna room, by use of the circulation blowing unit. The circulation blowing unit communicates with the blowing port through the ventilation flue having an inverse-L shape. Thereby, it is possible to supply high-temperature and high-humidity air to the sauna room, and it is possible to embody the sauna device with a small number of components by disposing the humidifying section in the air circulation duct. Therefore, it is possible to achieve reduction in weight of main body and reduction in cost. The fan motor used in the humidifying section becomes unnecessary as compared with the known techniques, and thus a low-noise sauna device is obtained.

According to another aspect of the invention, the sauna device described in the first aspect is, in order to achieve the object mentioned above, additionally configured such that the air heating unit is disposed on the outside of a casing forming the ventilation flue. Thereby, it is possible to increase a size of the air heating section in that the air heating section is provided free from an air duct area of the blowing side of the blower, and a sauna device is obtained, which is able to supply a large amount of high-temperature and high-humidity air.

DESCRIPTION OF REFERENCE NUMERALS AND SIGNS

1 SAUNA ROOM
8 HEATING/HUMIDIFYING UNIT
9 CONTROL UNIT
10 VENTILATING UNIT
12 CIRCULATION BLOWING SECTION
13 HEATING SECTION
14 HUMIDIFYING SECTION
19 ELECTRIC HEATER
20 HUMIDIFYING-SECTION AIR CIRCULATION DUCT
21 NOZZLE
22 INJECTION-WATER IMPACT SURFACE
23 WATER BREAKUP PORTION
24 VAPOR-LIQUID SEPARATION UNIT
25 RESERVOIR SECTION
26 NOZZLE SUPPLY PIPE
27 DRAIN OUTLET
29 OUTER AIRFLOW-PASSAGE RESERVOIR PORTION
30 OVERFLOW SENSING PORTION
31 SUCTION INLET
32 STOPPER
34 HEATED SPACE

PREFERRED EMBODIMENTS FOR CARRYING OUT THE INVENTION

Hereinafter, embodiments of the invention will be described with reference to the drawings.

Embodiment 1

Figure 2:
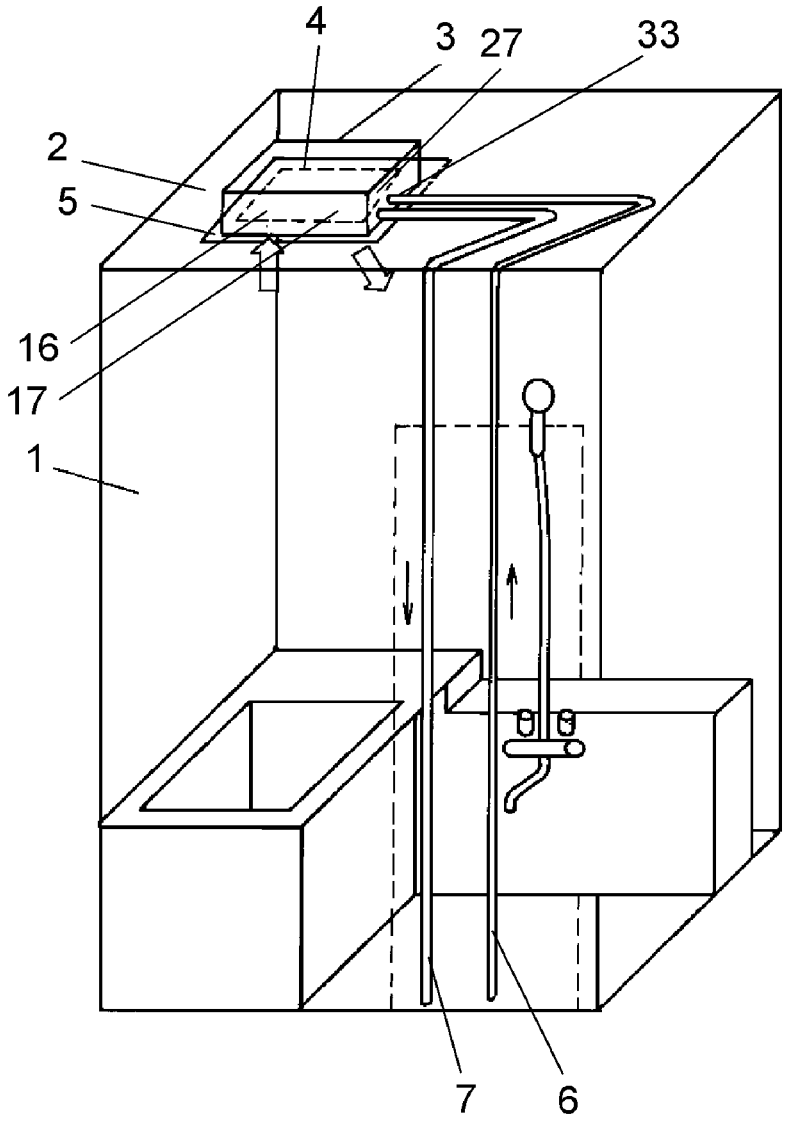
FIG. 2 is a schematic perspective view illustrating a state where the sauna device according to Embodiment 1 of the invention is installed in a sauna room 8.

As shown in FIG. 2, device main body 3 constituting a sauna device is provided in space 2 inside the ceiling of sauna room 1 such as a bathroom. Opening 4 formed on the bottom of device main body 3 communicates with sauna room 1 through ceiling opening 5. Feed-water inlet 33 and drain outlet 27 of device main body 3 are connected with water supply pipe 6 for supplying water to device main body 3 and drainpipe 7 for draining water from device main body 3. When the inside of sauna room 1 or device main body 3 is heated and humidified, tap water is sent to device main body 3 through water supply pipe 6, a part of tap water supplied from water supply pipe 6 is used for humidification, and water not used for humidification is drained from drainpipe 7. Opening 4 has suction port 16 and blowing port 17, thereby suctioning and blowing air as indicated by the arrow.

Figure 1:
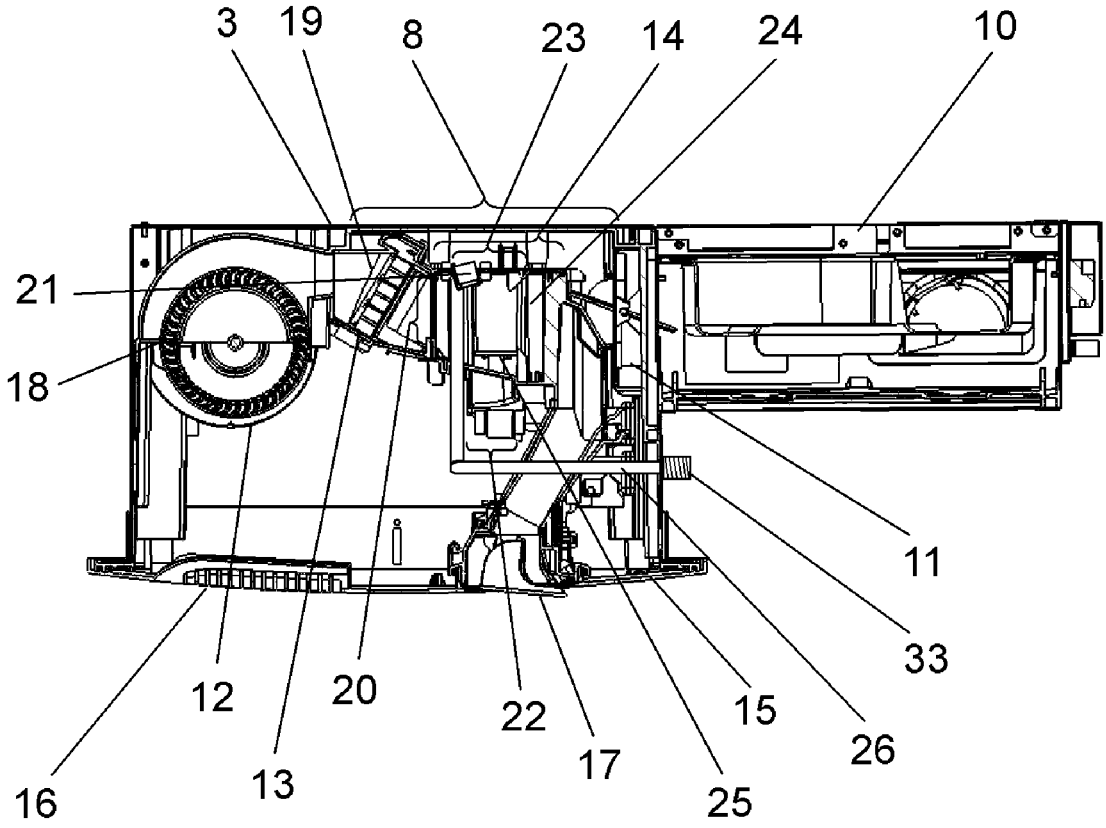
FIG. 1 is a side configuration view illustrating an internal configuration of a sauna device according to Embodiment 1 of the present invention.
Figure 3:
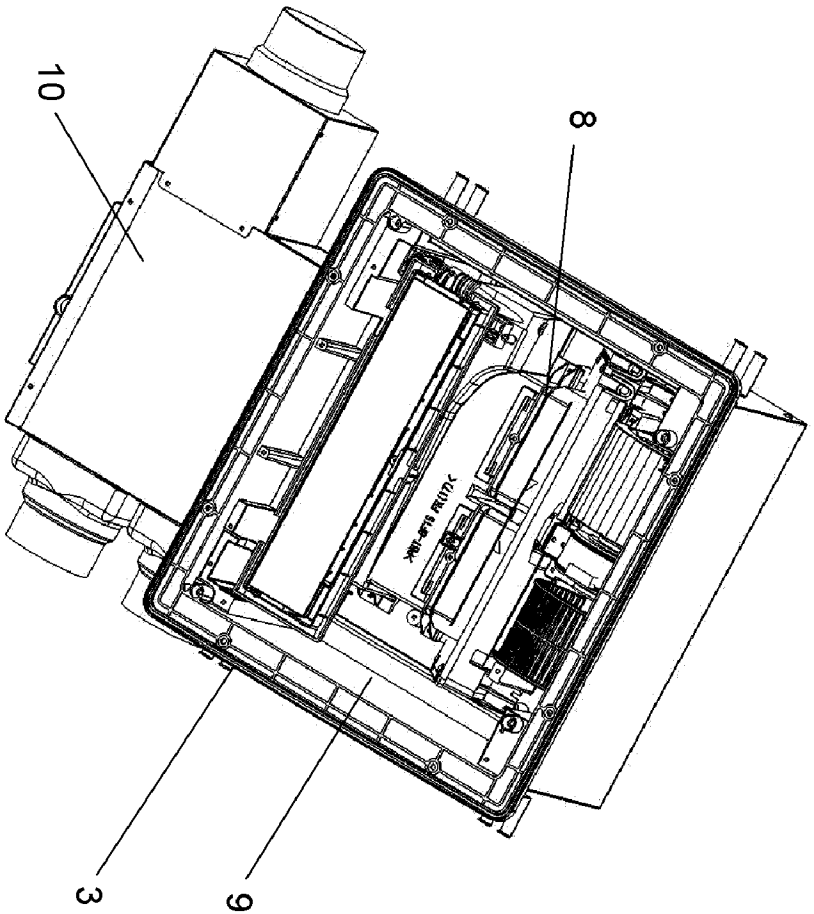
FIG. 3 is a schematic bottom view illustrating a state where a panel of the sauna device is detached according to Embodiment 1 of the invention.

As shown in FIG. 1, device main body 3 is formed in a box shape having one opening surface. Inside, there are built-in heating/humidifying unit 8 for heating/humidifying air and control unit 9 (see FIG. 3). Outside, there are provided ventilating unit 10 for exhausting air of sauna room 1 to the outdoors and damper 11 for controlling an opening shape which communicates ventilating unit 10 with device main body 3. Heating/humidifying unit 8 includes circulation blowing section 12 for circulating and blowing air of sauna room 1, heating section 13 for heating the air being circulated, and humidifying section 14 for humidifying the air being circulated. Control unit 9 shown in FIG. 3 is electrically connected to ventilating unit 10, damper 11, circulation blowing section 12, heating section 13, and humidifying section 14, and controls the respective operations of those.

On a position adjacent to sauna room 1, panel 15 is disposed. Panel 15 has suction port 16 and blowing port 17. By driving circulation blower fan 18 provided in circulation blowing section 12, the air in sauna room 1 is suctioned into device main body 3 via suction port 16, and is sent to heating section 13 of heating/humidifying unit 8 via circulation blowing section 12.

Heating section 13 includes electric heater 19. The air supplied by circulation blowing section 12 passes through the inside of electric heater 19, and is heated. Electric heater 19 is formed of heater element (not shown in the drawings) and thermally-conductive fin (not shown in the drawings). The thermally-conductive fin has a constant width in an air flow direction in order to effectively transfer the heat of electric heater 19 to the air flow. Thus, the air flow is rectified by the width of the thermally-conductive fin when passing electric heater 19. Electric heater 19 is provided in humidifying-section air circulation duct 20 having a substantially rectangular tube shape configured to connect from heating section 13 to humidifying section 14, and is mounted to have an angle at which the upper part thereof is the lead in the air flow direction. Specifically, electric heater 19 is mounted to have an angle at which the rectified air flow is concentrated on injection-water impact surface 22 on which the injection water of nozzle 21 provided on the upper part of humidifying section 14 is impacted. Accordingly, the air flow sent by circulation blowing section 12 is curved toward the bottom and is rectified by passing electric heater 19. Since electric heater 19 heats the air flow to 80° C. or more, the air at 80° C. or so is sent to injection-water impact surface 22.

Humidifying section 14 has nozzle 21 as water breakup portion 23 and injection-water impact surface 22. On the downstream side of the air flow, vapor-liquid separation unit 24 and reservoir section 25 for temporarily storing water are formed.

Figure 6:
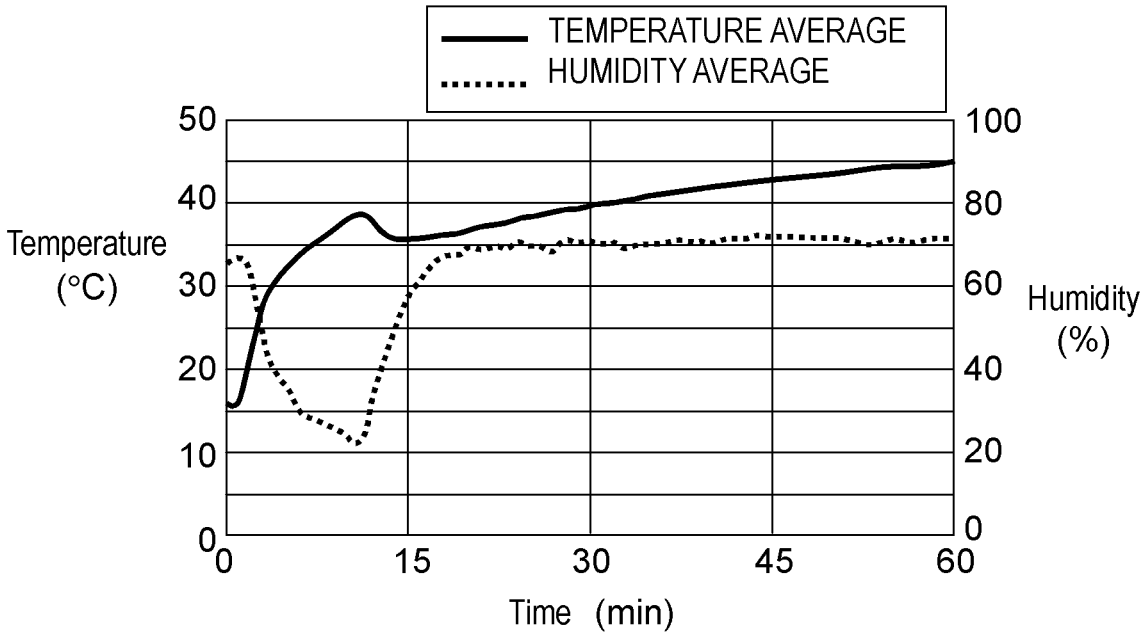
FIG. 6 is a view illustrating an increase in temperature and humidity in the sauna room of the sauna device according to Embodiment 1 of the invention.

Nozzle 21 is connected to nozzle supply pipe 26, and nozzle supply pipe 26 is directly connected to an aqueduct by feed-water inlet 33. Therefore, the water at room temperature is supplied to nozzle 21 via nozzle supply pipe 26, and is injected from nozzle 21. Nozzle 21 is a hollow cone type for injecting water droplets in a substantially cone shape where the droplets are concentrated on a surface thereof. Specifically, the supply water swirls in a spiral shape inside nozzle 21, and is injected from a jet orifice of nozzle 21. Since air gets involved therein when the water swirls, injection amount may be smaller than that of other nozzle types with respect to an identical water pressure. Since a diameter of the nozzle orifice can be increased, it is effective to blocking caused by scales and the like. Since an injection speed is high, injection particle size is small. The injection water injected from nozzle 21 is further micronized by impacting on injection-water impact surface 22 located on the lower side thereof. The micronized droplets are merged by circulation blowing section 12 with the air flow which is heated to 80° C. or more by electric heater 19, thereby generating humidified air. At this time, the injection water impacting on injection-water impact surface 22 includes a lot of micro droplets, and thus the water is injected as water at room temperature. However, since the water is broken up into micro droplets, the surface area thereof increases, and thus the area thereof in contact with the heated air flow increases. Hence, some droplets vaporize, and some droplets are carried by the air flow, and is guided to vapor-liquid separation unit 24 installed on the downstream side. By micronizing droplets as described above, the droplets tend to vaporize. Thereby, it becomes possible to sufficiently increase humidification performance by use of the water at room temperature. FIG. 6 shows an example of a rise in temperature and humidity in sauna room 1 when Embodiment 1 is employed. It can be seen from FIG. 6 that the inside of sauna room 1 is changed with time into a state of sufficient temperature and humidity.

In Embodiment 1, water is micronized by use of the injection water injected from water spray nozzle 21. However, gas-liquid mixture injected from two fluid nozzles may be used, and there is no difference in the action and effect.

Figure 4:
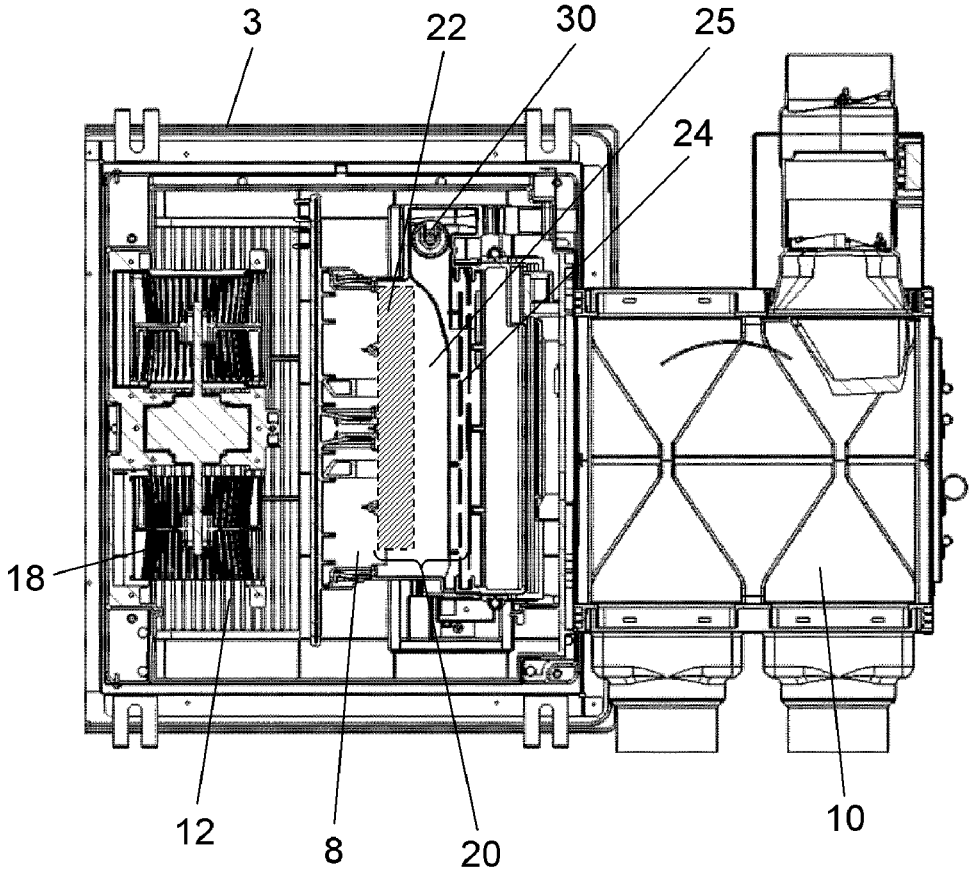
FIG. 4 is a schematic configuration view illustrating the sauna device according to Embodiment 1 of the invention as viewed from the top.
Figure 5:
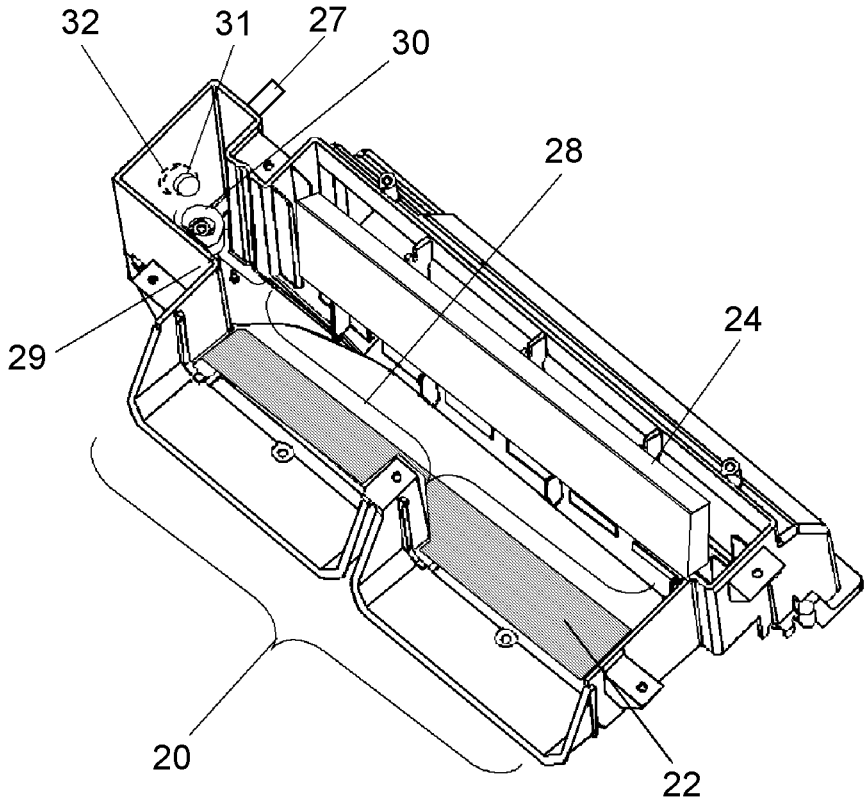
FIG. 5 is a schematic perspective view illustrating a part of a humidifying section of the sauna device according to Embodiment 1 of the invention.

As shown in FIGS. 1, 4, and 5, among the injected droplets merged with the heated air, some large droplets having a diameter of 1 μm or more fall on the lower surface of humidifying-section air circulation duct 20, but some droplets enter vapor-liquid separation unit 24. Vapor-liquid separation unit 24 has a shape in which thin and linear stainless wires are randomly weaved. The humidified air is obtained by merging the heated air with the droplets, which are generated by impacting on injection-water impact surface 22. When the humidified air passes thorough the stainless wires of vapor-liquid separation unit 24, the large droplets impact and adhere on the stainless wires and repeatedly adhere thereto. Thereby, the size of the adhered droplet increases, and thus the adhered droplet falls by its own weight into reservoir section 25 provided on the lower side. On the other hand, micro droplets having a diameter of 1 μm or less pass through gaps of the stainless wires of vapor-liquid separation unit 24 without impact, and are blown from blowing port 17 to sauna room 1.

Reservoir section 25 for temporarily storing water is provided on the lower part of vapor-liquid separation unit 24, and temporarily stores the large droplets collected from vapor-liquid separation unit 24. Reservoir section 25 is disposed to have a falling gradient steeper than that of injection-water impact surface 22 downwardly inclined from electric heater 19, and a part of the bottom face of reservoir section 25 is formed to have a falling gradient. The bottom face of reservoir section 25 is formed to have a falling gradient with respect to drain outlet 27, and the water stored in reservoir section 25 or the hot water is easily discharged through drain outlet 27 to the outside of device main body 3.

As shown in FIG. 5, reservoir section 25 includes reservoir-section circulation flow passage 28 disposed in a passage of the air flow supplied by circulation blowing section 12 and outer airflow-passage reservoir portion 29 disposed outside of the passage of the air flow, and drain outlet 27 is provided on outer airflow-passage reservoir portion 29. If drain outlet 27 is provided in reservoir-section circulation flow passage 28, air flow by circulation blowing section 12 also flows into drain outlet 27, and causes disturbed flow by encountering with air and water in the vicinity of drain outlet 27 of reservoir section 25 (see FIG. 4), and thus it becomes difficult to drain water. That is the reason why the above-mentioned configuration is employed. Drain outlet 27 has a diameter enough to satisfactorily discharge the water injected from nozzle 21. Some water injected from nozzle 21 is retained in reservoir section 25, but is discharged from drain outlet 27 to the outside of device main body 3 after a certain period of time. The water discharged from drain outlet 27 is generally introduced into a drainage channel and the like by constructing drainpipe 7 having a natural falling gradient. However, since device main body 3 is installed in space 2 inside the ceiling of the bathroom as sauna room 1, a convex part such as a rib may be formed on a border inside the ceiling of the bathroom, drainpipe 7 connected to drain outlet 27 of device main body 3 may be upwardly inclined by the border outside the bathroom as sauna room 1, and drainpipe 27 may be partially inclined upward as R increases when the pipe is made of resin and curved at the corner. Because of the construction disturbance mentioned above, water may not be drained out. It is the same in the case where drainpipe 7 is choked by scales and the like. Hence, a part of reservoir section 25 is provided with a float switch as overflow sensing portion 30. Overflow sensing portion 30 is provided in outer airflow-passage reservoir portion 29. When a storage capacity of reservoir section 25 reaches a certain value or more, the overflow sensing portion senses that the stored water is full, and then sends a signal to control unit 9 electrically connected thereto. Control unit 9 receives the detection signal of full capacity and sends a signal to an electromagnet valve (not shown in the drawings) as a water-supply opening/closing portion to close the water-supply valve, thereby stopping water supply. In this manner, the control unit stops injection from nozzle 21, and sends a signal to a remote control (not shown in the drawings) to display an alert sign. Since overflow sensing portion 30 is provided in outer airflow-passage reservoir portion 29, a surface of the stored water is not waved by air flow, and thus it is possible to sense a full state of the water capacity with high precision. On the other hand, since reservoir section 25 stores a constant amount of water, some droplets blown by circulation blowing section 12 and micronized by water breakup portion 23 come into contact with the stored water surface, and are introduced into vapor-liquid separation unit 24. When air comes into contact with the stored water surface of reservoir section 25, dry air is humidified, humidified air is sent to vapor-liquid separation unit 24, and humidified air including large droplets is absorbed in reservoir section 25 as the large droplets come into contact with the water surface. Hence, humidified air flow entering vapor-liquid separation unit 24 is sent as humidified air of which some large droplets are removed.

The humidified air passing vapor-liquid separation unit 24 is turned into humidified air including only micro droplets, and is supplied from blowing port 17 to sauna room 1. However, since the blown air itself is heated by electric heater 19, micro droplets blown from blowing port 17 are diffused in sauna room 1 with dew condensation suppressed. Specifically, since the micro droplets of the humidified air spread inside the bathroom as sauna room 1 in a micronized state, it is possible to provide sauna room 1 as a space free from concern about water droplets for a user. Therefore, it is possible to read a book in sauna room 1, and to widen an available range of sauna room 1. Since water breakup portion 23 micronizes water droplets by impact of water, it is possible to blow air including negative ions into sauna room 1 on the basis of Lenard Effect.

As shown in FIG. 5, a wall surface in the vicinity of reservoir section 25 of humidifying section 14 is provided with suction inlet 31. The reason why suction inlet 31 is provided is as follows. Though water supply pipe 6 and drainpipe 7 are constructed when device main body 3 is installed in space 2 in the ceiling of sauna room 1, drainpipe 7 may be not formed by natural falling gradient. In this case, the injection water injected from nozzle 21 is not discharged, and overflow sensing portion 30 senses the full state of the water capacity of reservoir section 25, thereby stopping the injection of nozzle 21. Hence, drainpipe 7 should be formed by a falling gradient. Meanwhile, since panel 15 is mounted at the last of construction, panel 15 is not mounted in the course of construction. Under this situation, device main body 3 is installed in space 2 inside the ceiling, and water supply pipe 6 and drainpipe 7 are connected. In this state, the outside of humidifying section 14 can be checked from the inside of device main body 3, that is, suction inlet 31 can be checked. When drainpipe 7 is constructed at the last, it is possible to easily check suction inlet 31 by detaching panel 15. When a small amount of water is supplied from suction inlet 31 into humidifying section 14 in the state where suction inlet 31 is checkable, the supplied water falls into reservoir section 25, and is introduced into drain outlet 27. The supply water introduced into drain outlet 27 is discharged from an opening side of drainpipe 7 when drainpipe 7 connected thereto has a falling gradient. Thereby, it is possible to apparently check that drainpipe 7 is constructed to have a falling gradient. On the other hand, when drainpipe 7 is constructed to have a rising gradient, overflow sensing portion 30 is able to sense the overflow stream before water is discharged from the opening portion of drainpipe 7. Alternatively, when a power is not supplied, it is possible to check disturbance in construction of drainpipe 7 by overflow from device main body 3. By providing suction inlet 31 near drain outlet 27, it is possible to check the construction state of drainpipe 7 without wetting the inside of humidifying section 14. Thus, it is possible to suppress the growth of bacteria caused by the residual of the supply water from suction inlet 31.

Meanwhile, after the checking of drainpipe 7 at construction is terminated, stopper 32 is mounted on suction inlet 31 to block suction inlet 31. Since stopper 32 blocks suction inlet 31 of humidifying section 14, leakage of the humidified air from suction inlet 31 does not occur. Therefore, it is possible to prevent droplet falling accompanied with a droplet adhering to the inside of the device main body caused by the leakage or deterioration in humidification capacity caused by leakage of humidification components.

Embodiment 2

Hereinafter, Embodiment 2 will be described. The same components as those of Embodiment 1 will be referenced by the same reference signs and numerals, and description thereof will be omitted.

Figure 7A:
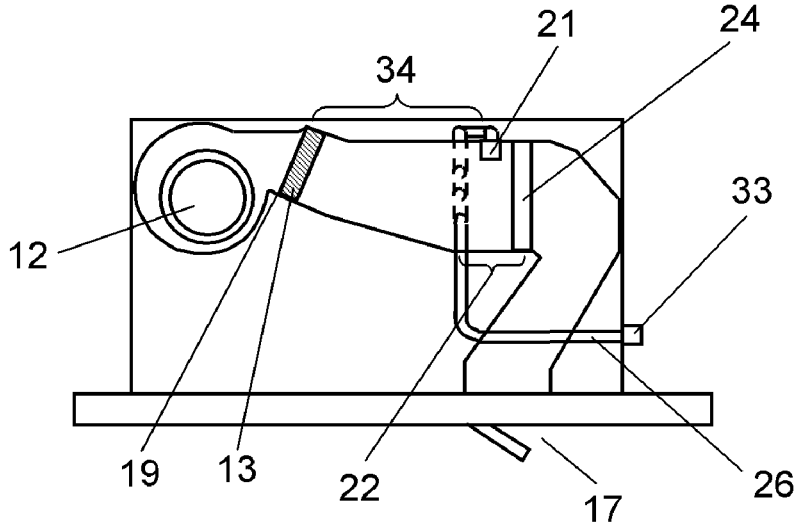
FIG. 7A is a schematic side configuration view illustrating a sauna device according to Embodiment 2 of the invention.
Figure 7B:
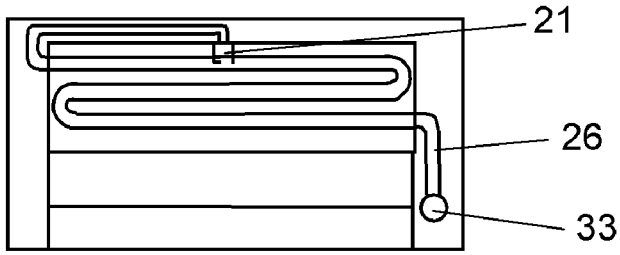
FIG. 7B is a schematic view illustrating a nozzle supply pipe in a humidifying-section air circulation duct of the sauna device according to Embodiment 2 of the invention.

As shown in FIG. 7A, heating section 13 includes electric heater 19. The air supplied by circulation blowing section 12 passes through the inside of electric heater 19, and is heated. Electric heater 19 is formed of heater element (not shown in the drawings) and thermally-conductive fin (not shown in the drawings). The thermally-conductive fin has a constant width in an air flow direction in order to effectively transfer the heat of electric heater 19 to the air flow. Thus, the air flow is rectified by the width of the thermally-conductive fin when passing electric heater 19. On the other hand, humidifying section 14 has nozzle 21 as water breakup portion 23 and injection-water impact surface 22. On the downstream side of the air flow, vapor-liquid separation unit 24 and reservoir section 25 for temporarily storing water are formed. Nozzle 21 is connected to nozzle supply pipe 26, and nozzle supply pipe 26 is directly connected to an aqueduct by feed-water inlet 33. As shown in FIG. 7B, the pipe is configured to be connected to nozzle 21 while having a serpentine shape in heated space 34 on the leeward of electric heater 19.

In this configuration, the water at room temperature supplied from feed-water inlet 33 is supplied through nozzle supply pipe 26, but the outer surface of nozzle supply pipe 26 is being in contact with the heated air heated to 80° C. or more by electric heater 19 when the supplied water at room temperature passes through heated space 34. Therefore, heat is exchanged through the outer surface of nozzle supply pipe 26. Accordingly, the supplied water at room temperature is turned into hot water before nozzle 21 by being heated through nozzle supply pipe 26 disposed in heated space 34, and the hot water is injected from nozzle 21. As an area of the outer surface of nozzle supply pipe 26 becomes larger in a part thereof located in heated space 34, and as a diameter of nozzle supply pipe 26 becomes smaller, an obtained amount of heat increases. As a flow rate of the water at room temperature flowing in nozzle supply pipe 26 becomes slower, a temperature of the supply water supplied to nozzle 21 increases. If sufficient temperature can be supplied to the supply water, it is not necessary for nozzle supply pipe 26 to have a serpentine shape in heated space 34.

Since the injection water injected from nozzle 21 is turned into hot water, the injection water impacting on injection-water impact surface 22 is also hot water. The injection water impacting on injection-water impact surface 22 is further micronized, and the micronized droplets are merged by circulation blowing section 12 with the air flow which is heated to 80° C. or more by electric heater 19, thereby generating humidified air. At this time, the injection water impacting on injection-water impact surface 22 includes a lot of micro droplets. Thus, when the injection water is water at room temperature, some heated air supplied from electric heater 19 releases latent heat at the time of vaporization of the micro droplets, thereby lowering a temperature thereof. In contrast, when the injection water is hot water, it is possible to reduce a decrease rate of temperature of the heated air, and it is possible to turn the humidified air supplied from blowing port 17 into high-humidity and high-temperature air. Additionally, it is possible to increase humidification performance.

Embodiment 3

The installation form of a sauna device in a sauna room is similar to that of Embodiment 1 as shown in FIG. 2. The same components as those of Embodiment 1 will be referenced by the same reference signs and numerals, and description thereof will be omitted.

Figure 8:
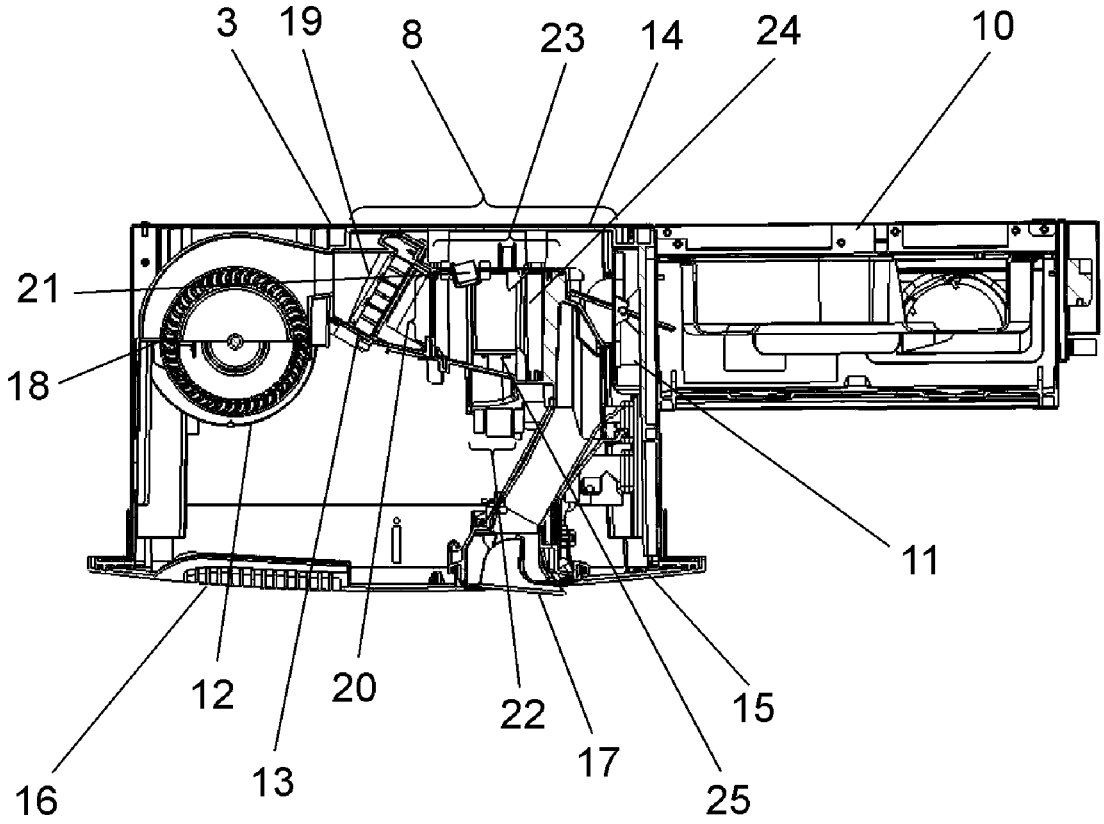
FIG. 8 is a side configuration view illustrating an internal configuration of a sauna device according to Embodiment 3 of the invention.
Figure 9:
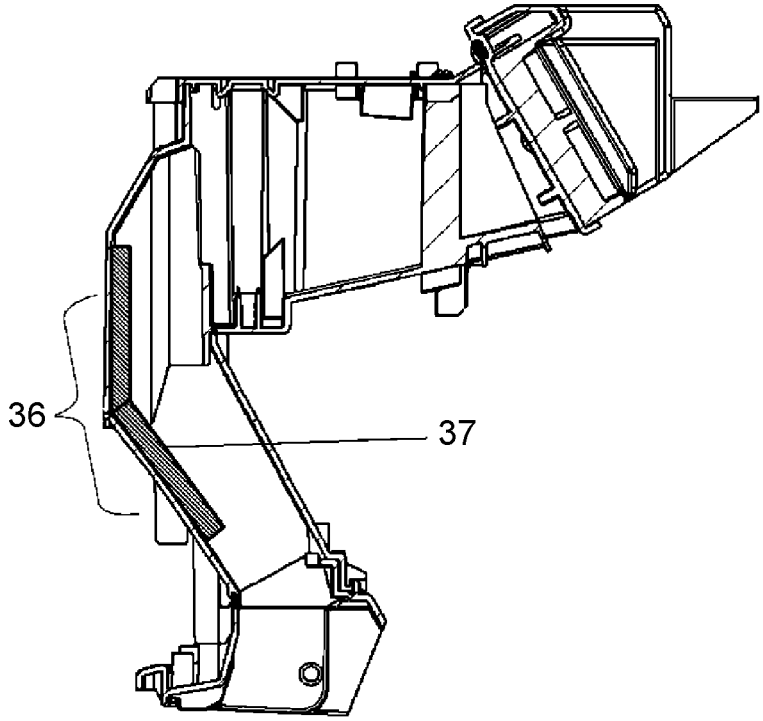
FIG. 9 is a schematic sectional view illustrating an air-blowing duct of the sauna device according to Embodiment 3 of the invention.

FIG. 8 is a side configuration view illustrating a configuration of the sauna device of the embodiment. Here, a part for blowing air from the humidifying section to blowing port 17 is referred to as air-blowing duct 35. FIG. 9 is a schematic sectional view illustrating an air duct including air-blowing duct 35 and humidifying-section air circulation duct 20 shown in FIG. 8.

As shown in FIG. 9, bent portion 36 is not connected in a continuous curve shape but connected in a rectilinear shape in a section of the wall, and thus the noise generated from the fan motor impacts on the upper wall surface of bent portion 36, and reflects toward a side opposite to the transpiration side thereof. Hence, it becomes easy to cut sound. When a sound-absorbing material is attached to a curved surface, the sound-absorbing material tends to be taken off by elasticity thereof, and it is difficult to secure a space therefor. However, in this embodiment, the bent portion is formed as rectilinear surfaces, and thus it is easy to secure a space covered with sound-absorbing material 37 having a sound insulation effect.

The humidified air impacts on the upper wall surface of bent portion 36 or on sound-absorbing material 37 on the upper wall surface, and moisture is adhered to the wall surfaces, thereby removing the moisture. A falling direction of the removed water and a blowing direction are changed by the bent portion. Droplets are minutely separated by energy of impact on the wall surface or sound-absorbing material 37.

Embodiment 4

The same components as those of Embodiments 1 to 3 will be referenced by the same reference signs and numerals, and detailed description thereof will be omitted.

Figure 10:
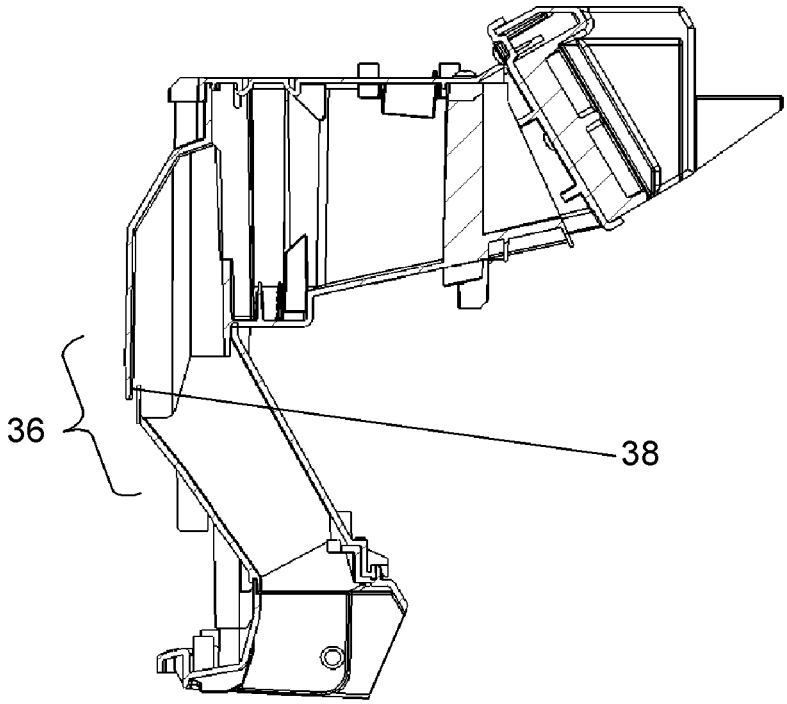
FIG. 10 is a schematic sectional view illustrating an air-blowing duct of a sauna device according to Embodiment 4 of the invention.
Figure 11:
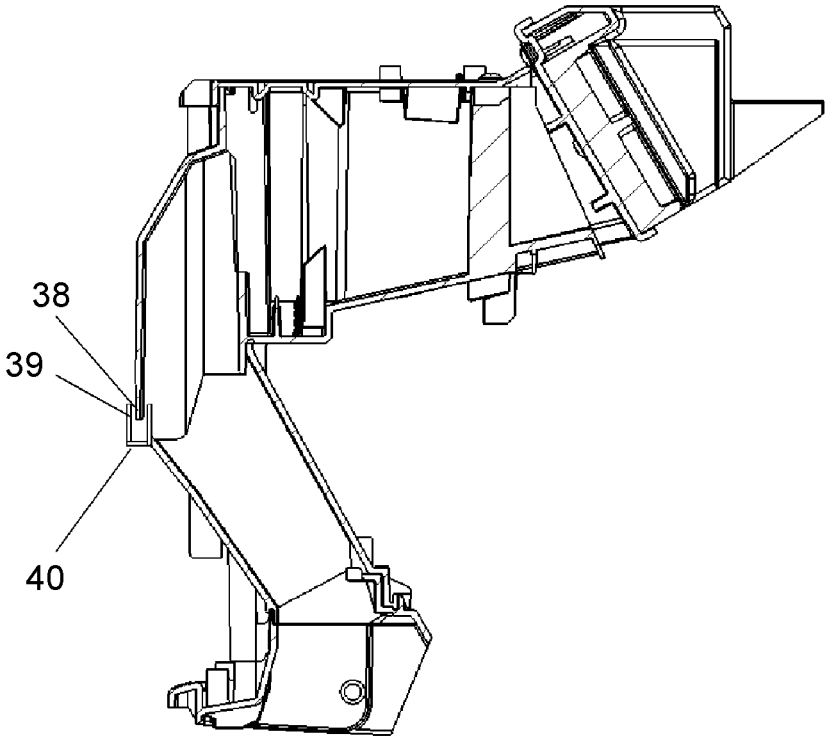
FIG. 11 is a schematic sectional view illustrating an air-blowing duct of a sauna device as a modified example of Embodiment 4 of the invention.

As shown in FIG. 10, rib 38 is provided on the outer periphery of bent portion 36, and the humidified air impacts on the upper wall surface of bent portion 36, and moisture is adhered to the wall surfaces, thereby removing the moisture. The moisture adhered to the wall surface runs down along the wall surface, reaches rib 38 of bent portion 36, and then drops on the outside of the air duct. The air in which moisture is removed is blown in a direction changed at bent portion 36. When rib 38 of the outer periphery is formed in a groove shape as shown in FIG. 11, as described above, the moisture adhered to the wall surface runs down along the wall surface and drops from the end face of rib 38, the droplets enter droplet-collecting grove 40, and then are naturally dried in the groove or are discharged out of the air duct along the groove.

Embodiment 5

The same components as those of Embodiments 1 to 4 will be referenced by the same reference signs and numerals, and detailed description thereof will be omitted.

Figure 12:
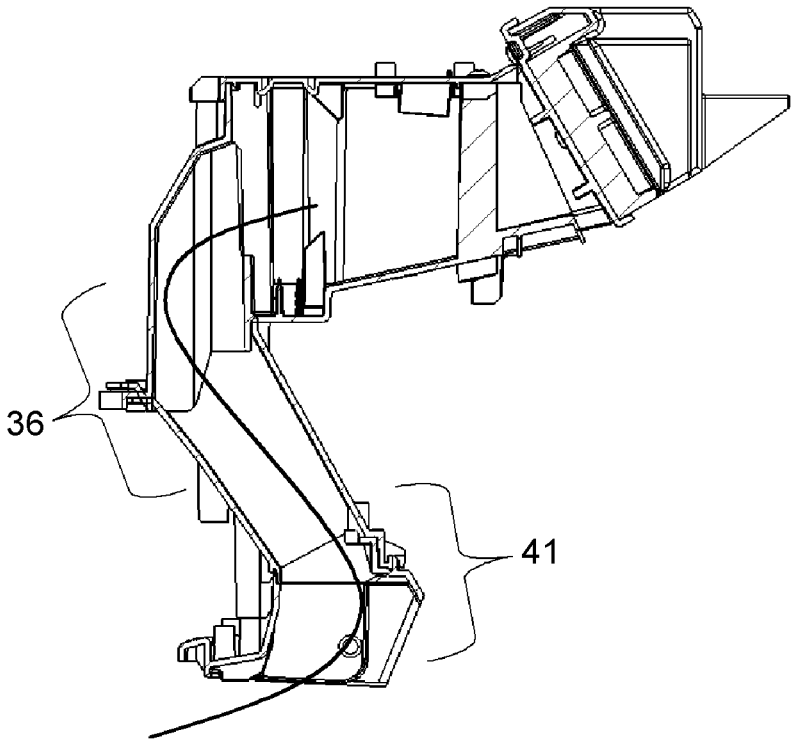
FIG. 12 is a schematic sectional view illustrating an air-blowing duct of a sauna device according to Embodiment 5 of the invention.

As shown in FIG. 12, bent portion 36 and bent portion 41, that is, two bent portions are provided, and the air duct is formed in a substantially S shape as shown in the drawing. Thereby, the noise generated from the fan motor impacts on the upper wall surface of first bent portion 36, and reflects toward a side opposite to the blowing side thereof, and thus it becomes easy to cut sound. The noise passing through bent portion 36 impacts on the lower wall surface of bent portion 41, and similarly, the noise reflects toward a side opposite to the blowing port thereof, thereby obtaining higher sound insulation effect.

The humidified air impacts on the upper wall surface of bent portion 36, and moisture is adhered to the wall surfaces, thereby removing the moisture. A falling direction of the removed water and a blowing direction are changed by the bent portion. Additionally, the humidified air passing through bent portion 36 impacts on the lower wall surface of bent portion 41, and moisture is adhered to the wall surfaces, thereby removing the moisture and changing the blowing direction. Even in any one of bent portion 36 and bent portion 41, droplets are minutely separated by energy impacting on the wall surface.

Embodiment 6

The same components as those of Embodiments 1 to 5 will be referenced by the same reference signs and numerals, and detailed description thereof will be omitted.

Figure 13:
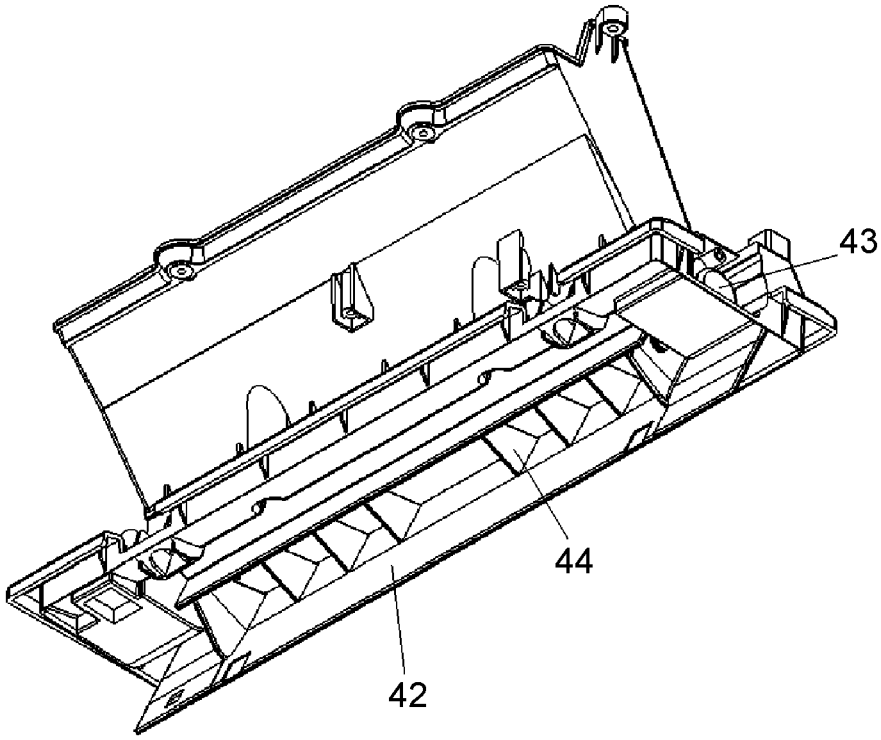
FIG. 13 is a schematic perspective view illustrating a blowing port of a sauna device according to Embodiment 6 of the invention.
Figure 14:
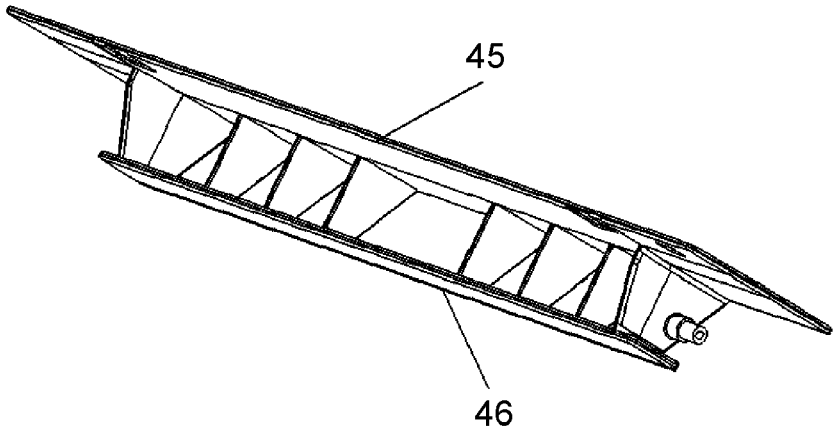
FIG. 14 is a schematic perspective view illustrating a wind-direction changing plate of the sauna device according to Embodiment 6 of the invention.
Figure 15A:
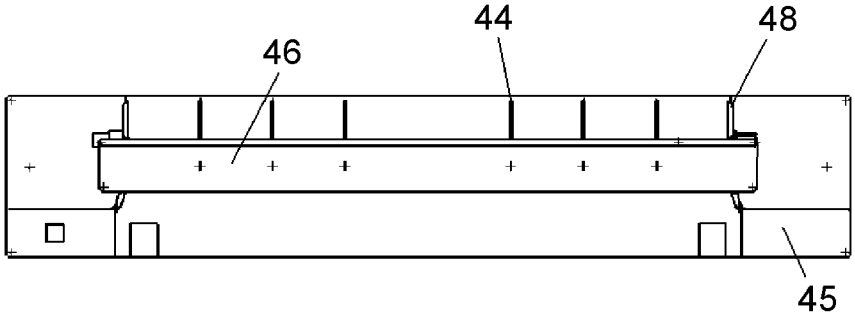
FIG. 15A is a top plan view illustrating the wind-direction changing plate of the sauna device according to Embodiment 6 of the invention.
Figure 15C:
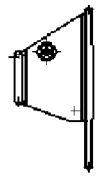
FIG. 15C is a side view illustrating the wind-direction changing plate of the sauna device according to Embodiment 6 of the invention.
Figure 15B:
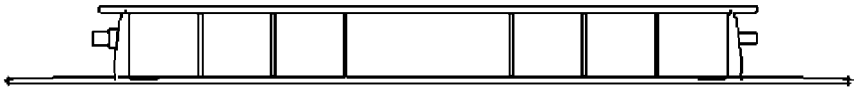
FIG. 15B is a front view illustrating the wind-direction changing plate of the sauna device according to Embodiment 6 of the invention.

FIGS. 13 and 14 are perspective views illustrating a blowing port and a wind-direction changing plate of a sauna device according to Embodiment 6, respectively. FIGS. 15A to 15C are views illustrating the wind-direction changing plate according to Embodiment 6 as viewed from three side.

As shown in FIGS. 13, 14, and 15A to 15C, wind-direction changing plate 42 has shafts on the right and left in a longitudinal direction. The one shaft is rotatably inserted into the hole in the air duct, and the other shaft is concentrically fixed to a shaft of step motor 43. Step motor 43 supporting the one shaft of wind-direction changing plate 42 is optionally rotated by remote control, thereby changing a direction of blowing the humidified air. The blade shape is formed by two blades, external blade 45 and internal blade 46. Rib 44 located on the center of a plurality of ribs 44 supporting the two blades is formed straightly, and Ribs 44 apart from each other in the right and left direction are formed to gradually decrease the size of R shape of the surface as distance from the center increases. Wind passing through the blade shape spreads in the right and left direction by following the R shape. By setting a transverse size of internal blade 46 equal to or less than ⅓ of external blade 45, a pressure loss caused by impact of air flow against internal blade 46 is reduced, and thus a blowing wind speed and a sufficient amount of the air flow following external blade 45 are secured.

Figure 16:
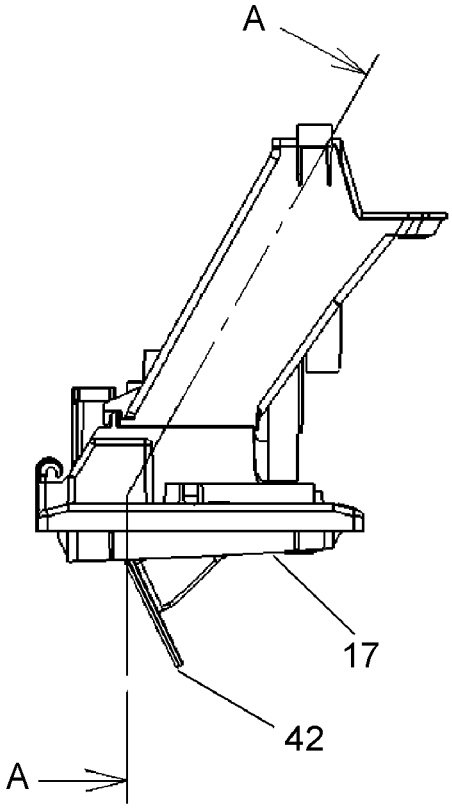
FIG. 16 is a schematic side view illustrating an air-blowing duct of the sauna device according to Embodiment 6 of the invention.
Figure 17:
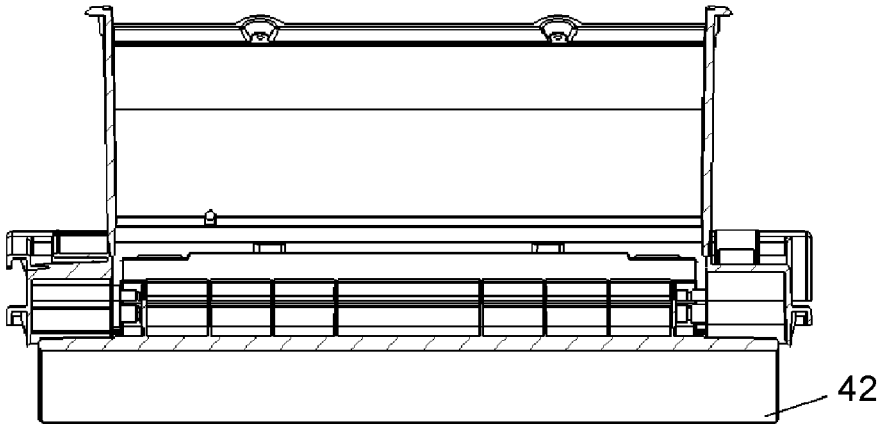
FIG. 17 is a sectional view illustrating the air-blowing duct of the sauna device according to Embodiment 6 of the invention, which is taken along line A-A shown in FIG. 16.
Figure 18:
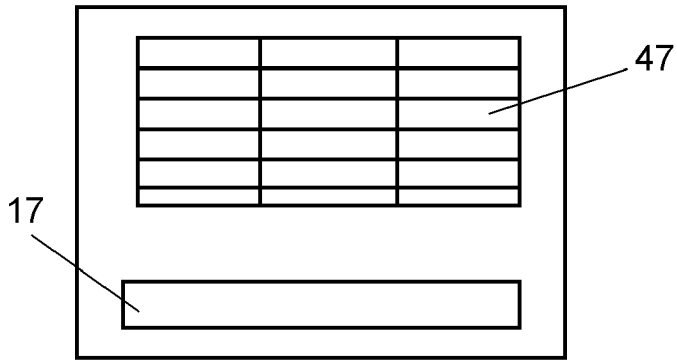
FIG. 18 is a schematic front view illustrating the sauna device according to Embodiment 6 of the invention as viewed from an opening of the bottom.

FIGS. 16 and 18 are a schematic side view illustrating an air-blowing duct of the sauna device according to Embodiment 6 and a schematic front view illustrating the sauna device as viewed from an opening of the bottom, respectively. FIG. 17 shows a section taken along line A-A shown in FIG. 16.

The internal air duct to the blowing port is restricted in a longitudinal direction to secure spaces of control unit 9 and overflow sensing portion 30 described in Embodiment 1. However, in the vicinity of the blowing opening, the spaces of the control unit and the overflow sensing portion become unnecessary. Accordingly, blowing port 17 is changed from an air duct shape from the vicinity of the opening thereto to extend in the longitudinal direction, thereby widening the opening. Then, the extended opening space houses wind-direction changing plate 42. The shape of internal blade 46 is adjusted to the longitudinal size of the unextended opening, and the shape of external blade 45 is adjusted to the longitudinal size of the extended opening. Specifically, the shape of wind-direction changing plate 42 is formed as a shape wider than air-blowing duct 35. The wind blown from the upstream of the air duct is blown to the bathroom space along external blade 45 while spreading to the right and left along ribs 44. Hence, temperature and humidity distribution in a direction perpendicular to the blowing direction is improved.

By extending the opening in the longitudinal direction of blowing port 17, the longitudinal size of blowing port 17 can be superposed on the extension of the longitudinal size of suction opening 47 having a wide opening size, thereby enhancing design freedom.

Embodiment 7

Figure 19:
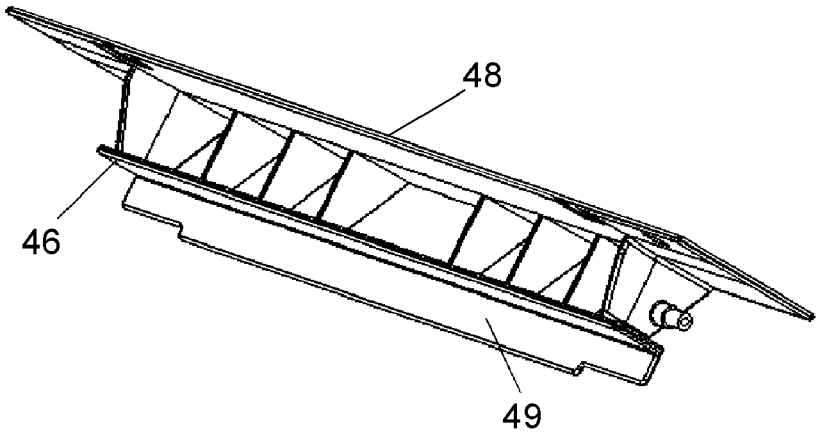
FIG. 19 is a schematic perspective view illustrating a wind-direction changing plate of a sauna device according to Embodiment 7 of the invention.
Figure 20:
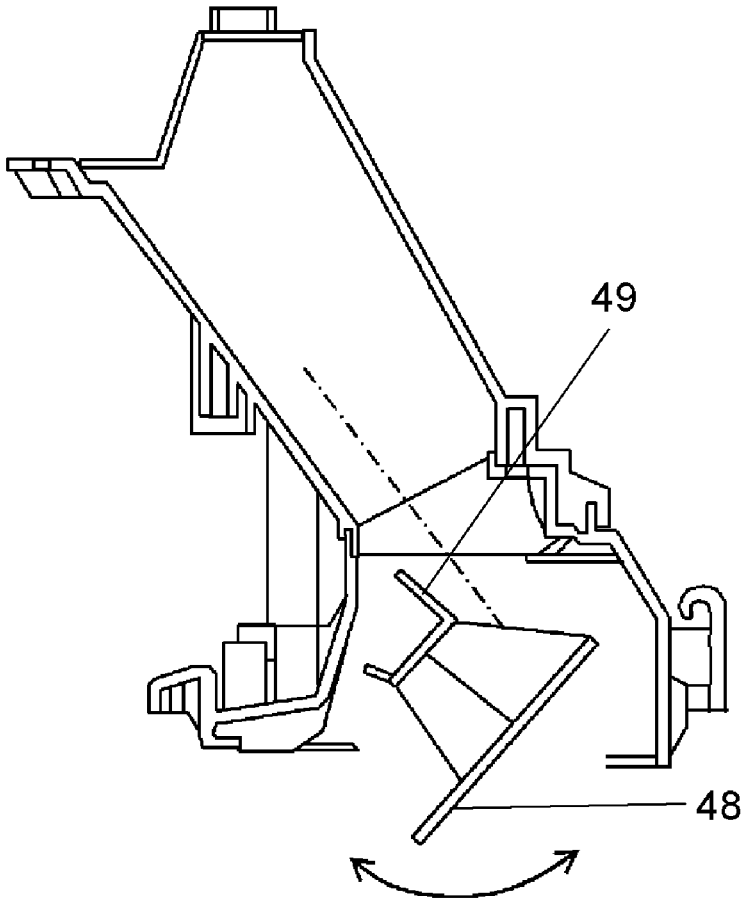
FIG. 20 is a schematic sectional view illustrating an air-blowing duct of the sauna device according to Embodiment 7 of the invention.

FIGS. 19 and 20 are a perspective view illustrating a wind-direction changing plate of a sauna device and a schematic sectional view illustrating an air-blowing duct according to Embodiment 7, respectively.

The same components as those of Embodiments 1 to 6 will be referenced by the same reference signs and numerals, and detailed description thereof will be omitted.

Wind-direction changing plate 48 has wing 49 formed at a certain angle on an end face of internal blade 46. Wing 49 enables to narrow the inside of the blowing opening during change. Thereby, an air-blowing area of blowing port 17 is changeable by hanging wing 49, and thus it is possible to change a wind speed strength. For example, when the wing is adjusted to be superposed on the extension of the bent portion as shown in FIG. 20, a frictional resistance of air in the air duct decreases, and a wind speed increases. The air flow along wing 49 impacts on external blade 45, and is blown to the bathroom space along external blade 45. With respect to the variable position of wind-direction changing plate 48 of when the center of the washing place of the bathroom is set as the target, the position of the wing is designed to be an extension of the bent portion as described above. Thereby, it is possible to secure a wind speed capable of reaching the bottom, and temperature and humidity distribution in the bathroom, particularly, distribution in an up and down direction in the bathroom is improved.

Embodiment 8

Figure 21:
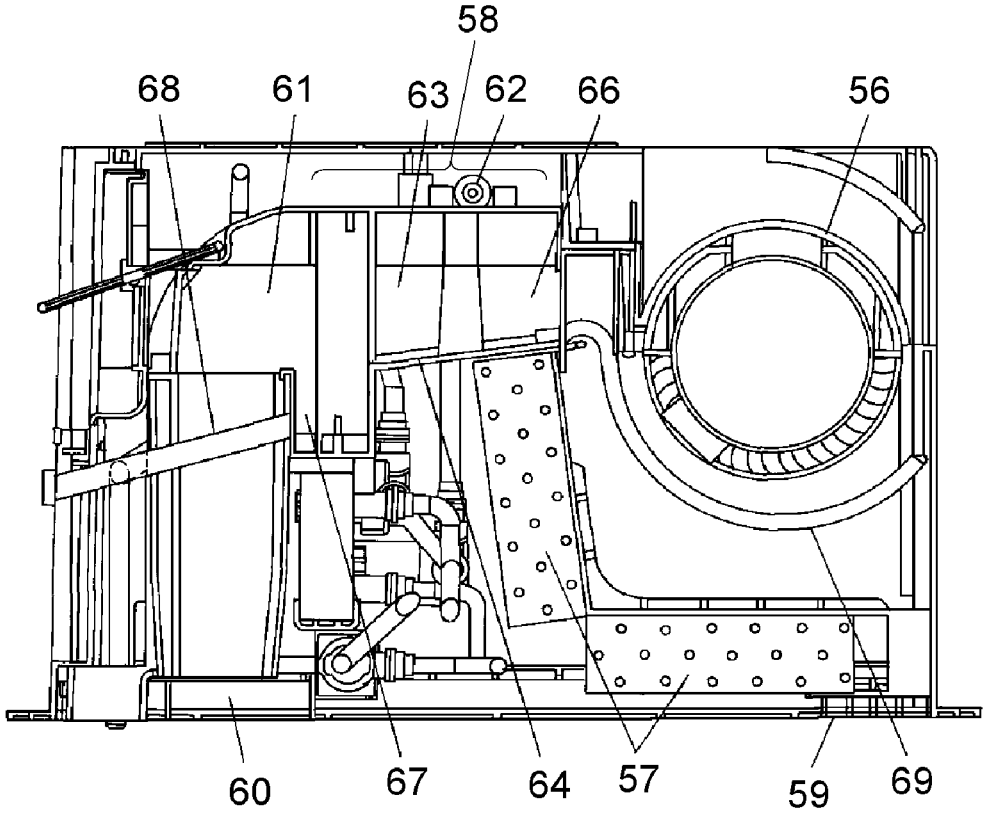
FIG. 21 is a side configuration view illustrating an internal configuration of a sauna device according to Embodiment 8 of the invention.
Figure 22:
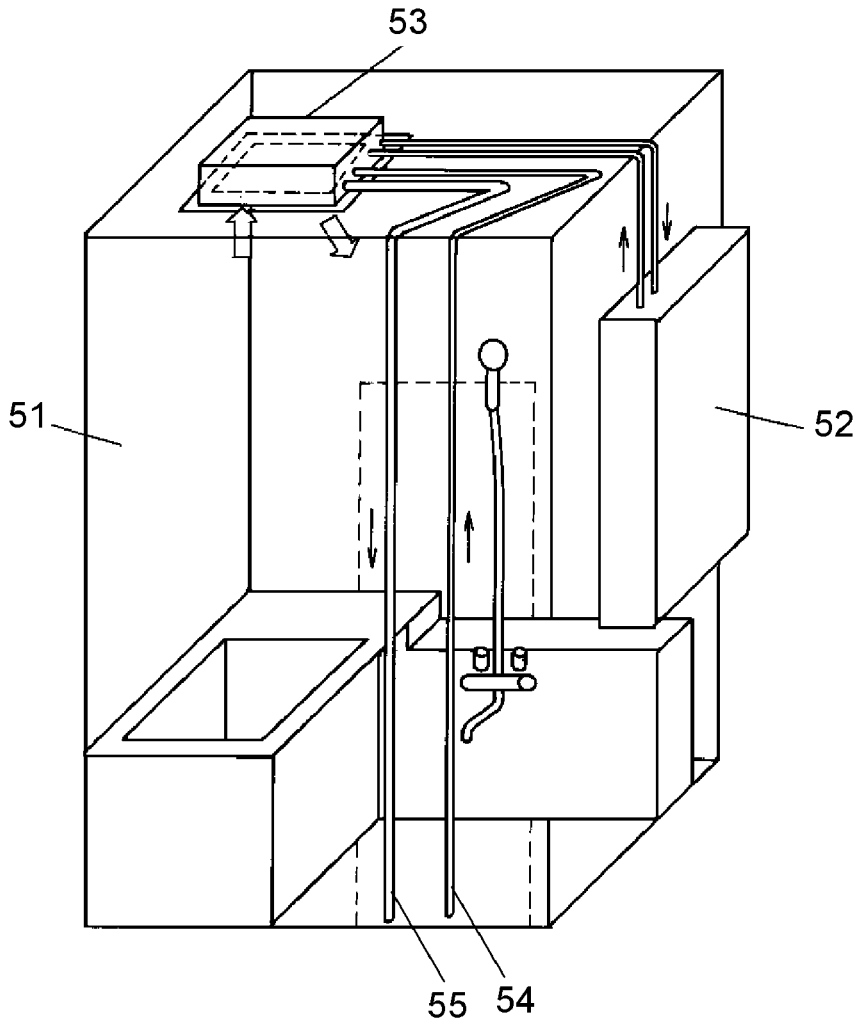
FIG. 22 is a schematic perspective view illustrating a state where the sauna device according to Embodiment 8 of the invention is installed in a sauna room.

As shown in FIGS. 21 and 22, a sauna device according to the embodiment includes: circulation blowing unit 56 for circulating air in sauna room 51 such as a bathroom; air heating unit 57 for performing heat exchange by use of hot water supplied from water heater 52 and heating air; humidifying unit 58 for humidifying air; and ventilation flue 61 for suctioning air of sauna room 51 from suction port 59, passing the air through air heating unit 57, and blowing the air from blowing port 60 through the humidifying unit to the sauna room 51, by use of circulation blowing unit 56. A main body 53 of the sauna device is formed such that circulation blowing unit 56 communicates with the blowing port 60 through ventilation flue 61 having an inverse-L shape.

As humidifying unit 58, ejecting port 62 for ejecting water supplied from water supply pipe 54 is provided on horizontal ventilation flue portion 63 which is substantially horizontal in ventilation flue 61 formed in the inverse-L shape. Lower surface 64 of horizontal ventilation flue portion 63 is provided to have a falling gradient from blower blowing port 66 of circulation blowing unit 56. Reservoir section 67 is provided on an end portion of horizontal ventilation flue portion 63, and draining path 68 capable of draining water from reservoir section 67 to the outside is provided. The water drained from draining path 68 is generally introduced into a drainage channel and the like by drainpipe 55.

Air heating unit 57 is disposed on the outside of casing 69 forming ventilation flue 61, and is formed in a substantially L shape or angular U shape to surround casing 69.

Figure 23:
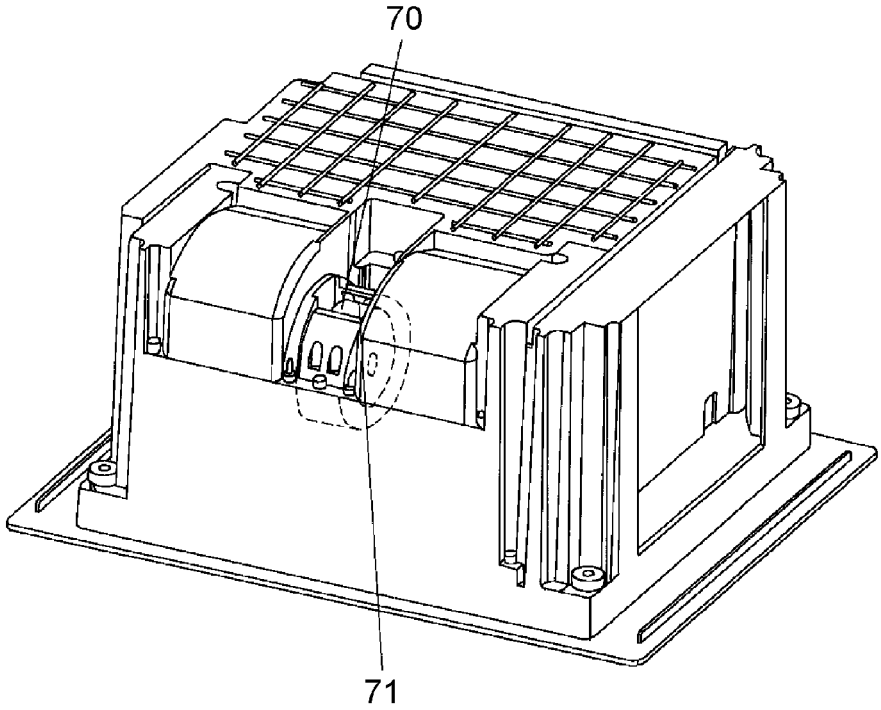
FIG. 23 is a schematic perspective view illustrating a motor part of the sauna device according to Embodiment 8 of the invention.

As shown in FIG. 23, a motor part of the sauna device is configured such that motor 70 used in circulation blowing unit 56 is provided outside of the ventilation flue, and opening 71 is provided on a part covering an upper part of motor 70.

In the configuration, the sauna device according to the embodiment includes circulation blowing unit 56 for circulating air in sauna room 51; air heating unit 57 for heating air; humidifying unit 58 for humidifying air; and ventilation flue 61 for passing the air through air heating unit 57, and blowing the air from blowing port 60 through humidifying unit 58 to the sauna room 51, by use of circulation blowing unit 56. Circulation blowing unit 56 communicates with the blowing port 60 through ventilation flue 61 having an inverse-L shape. Therefore, it is possible to increase a length of ventilation flue 61 from circulation blowing unit 56 to blowing port 60, and to increase humidified space. Accordingly, it is possible to increase humidification performance, and the humidifying air-blowing unit used in the known sauna device becomes unnecessary. It is possible to dispose blowing port 60 to be closer to the center of the bathroom as sauna room 51, and it is possible to set a long distance from blowing port 60 to the fan motor of circulation blowing unit 56 which is a noise source.

With the configurations, the sauna device according to the embodiment is operable to supply high-temperature and high-humidity air to whole sauna room 51, and can be embodied with a small number of components by disposing humidifying unit 58 in the air circulation duct. Therefore, it is possible to achieve reduction in weight of main body and reduction in cost. The fan motor used in humidifying unit 58 becomes unnecessary as compared with the known techniques, and thus it is possible to achieve reduction in noise.

Ejecting port 62 is provided on substantially horizontal ventilation flue portion 63 of ventilation flue 61 formed in the substantially inverse-L shape. Therefore, when the humidified air is turned into droplets by contacting the wall surface of ventilation flue 61, first the droplets are collected in the bottom of ventilation flue 61. Thus, the droplets hardly fall directly from blowing port 60 to sauna room 51, and a user hardly has uncomfortable feeling caused by the droplets falling from blowing port 60.

Lower surface 64 of horizontal ventilation flue portion 63 is provided to have a falling gradient from blower blowing port 66 of circulation blowing unit 56, reservoir section 67 is provided on an end portion of the horizontal ventilation flue portion 63, and draining path 68 capable of draining water from reservoir section 67 to the outside is provided. Therefore, when the humidified air is turned into droplets by contacting the wall surface of ventilation flue 61, the droplets are introduced through ventilation flue 61 of which lower surface 64 has a falling gradient into reservoir section 67, and are discharged to the outside through draining path 68. Accordingly, moisture does not pool in ventilation flue 61, and thus mould, bacteria, and the like hardly occurs.

Air heating unit 57 is disposed on the outside of casing 69 forming ventilation flue 61. Therefore, air heating unit 57 can be formed to be large, and it is possible to decrease a heating ability and an air-blowing resistance. When air heating unit 57 is disposed in ventilation flue 61, a size of ventilation flue 61 is restricted by a size of circulation blowing unit 56, and thus a size of air heating unit 57 is restricted. However, since air heating unit 57 can be provided regardless of an air duct area of blower blowing port 66 side, it is possible to increase the size of air heating unit 57, and it is possible to supply a large amount of high-temperature and high humidity air.

Air heating unit 57 is formed in a substantially L shape or angular U shape to surround casing 69. Therefore, air heating unit 57 can be effectively disposed, and the heating area can be increased. Thereby, it is possible to heat air in air heating unit 57 having a large size, and it is possible to increase a humidification amount and a heat amount. Thus, it is possible to shorten a starting time of the sauna device.

Motor 70 used in circulation blowing unit 56 is provided outside of ventilation flue 61, and opening 71 is provided on a part covering an upper part of motor 70. When the air heated by air heating unit 57 passes through circulation blowing unit 56, a frame is formed in a concave shape according to a shape of motor 70 such that motor 70 is not exposed directly to hot air, and is installed outside of ventilation flue 61. Thereby, it is possible to suppress rise in temperature of motor 70. By installing opening 71, motor 70 or an ambient space thereof is configured not to be filled with a heat, and thus it is possible to suppress rise in temperature of motor 70, and it is possible to improve durability of motor 70.

Embodiment 9

The same components as those of Embodiment 8 will be referenced by the same reference signs and numerals, and detailed description thereof will be omitted.

Figure 24:
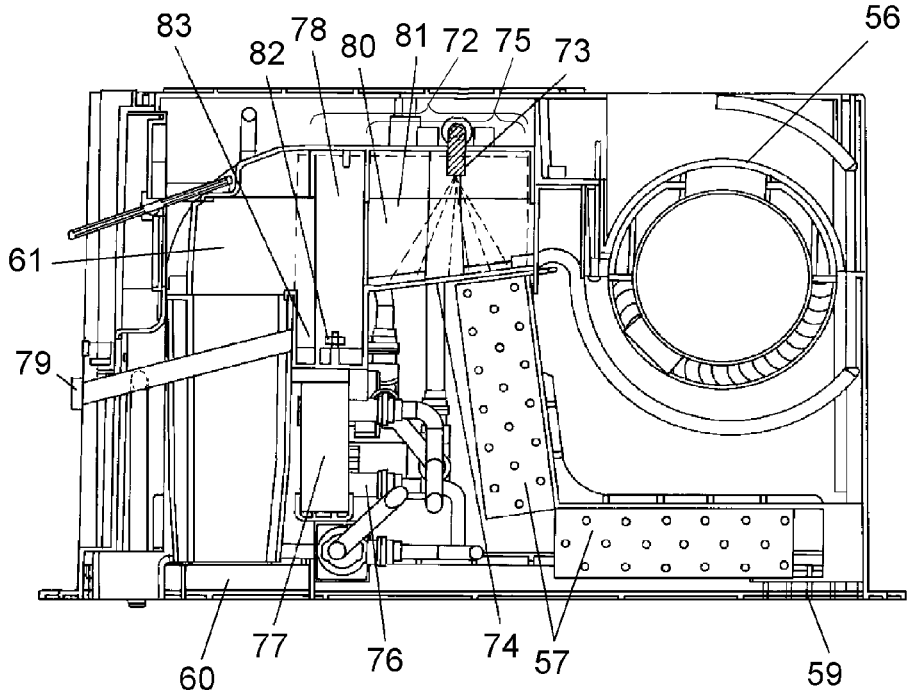
FIG. 24 is a side configuration view illustrating an internal configuration of a sauna device according to Embodiment 9 of the invention.
Figure 25:
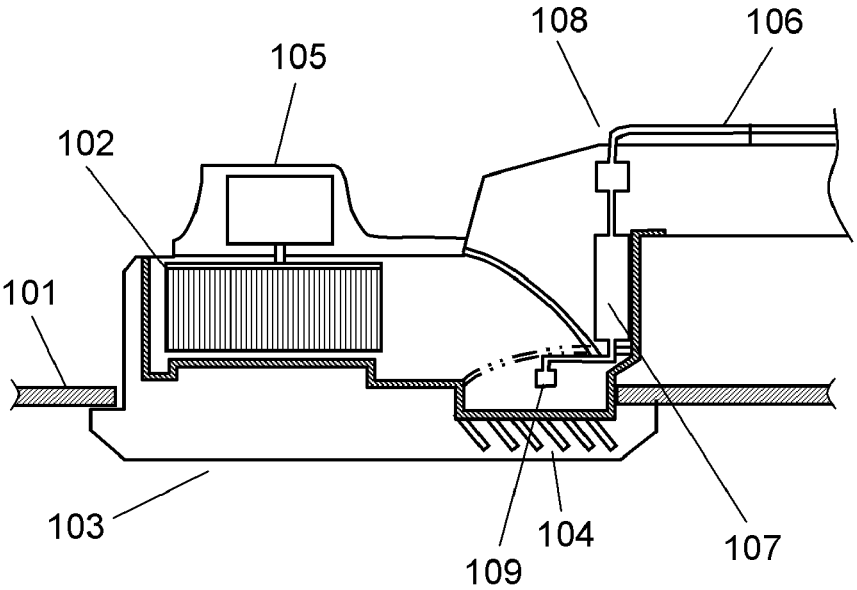
FIG. 25 PRIOR ART
FIG. 25 is a main-part sectional view schematically illustrating an inner structure according to a first example of a known sauna device.
Figure 26:
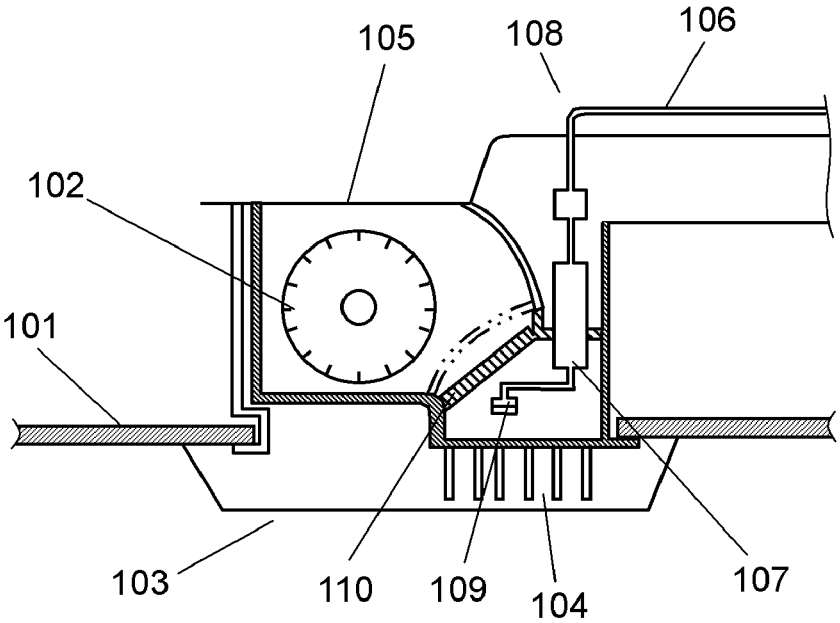
FIG. 26 PRIOR ART
FIG. 26 is a main-part sectional view schematically illustrating an inner structure according to a second example of the known sauna device.
Figure 27:
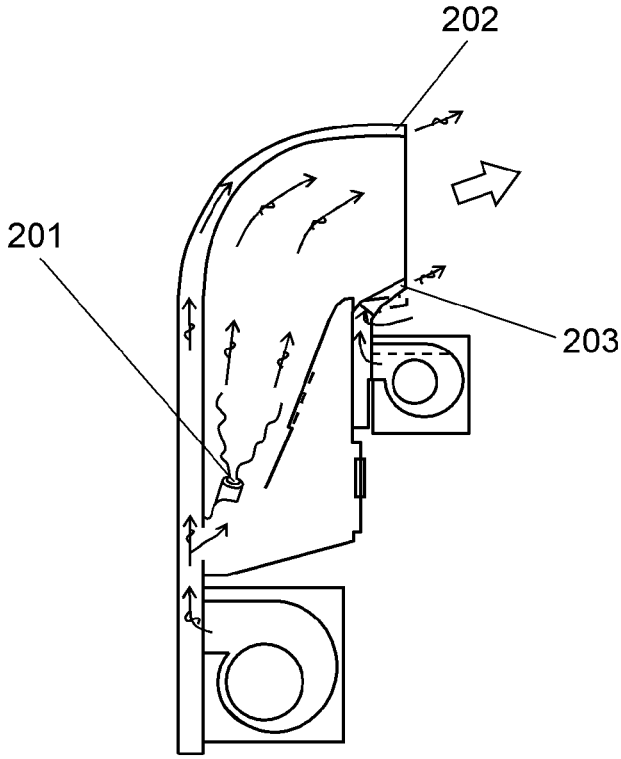
FIG. 27 PRIOR ART
FIG. 27 is a view illustrating an internal structure of a sauna device disclosed as a spray device, according to a third example of the known sauna device.
Figure 28:
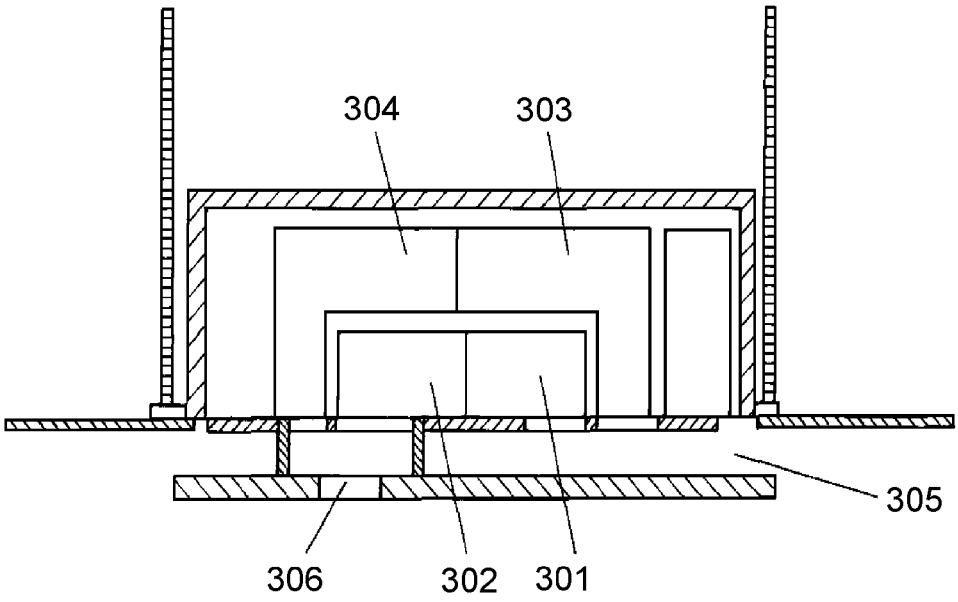
FIG. 28 PRIOR ART
FIG. 28 is a side sectional view illustrating a mist functional sauna device used in a bathroom, according to a fourth example of the known sauna device.
Figure 29:
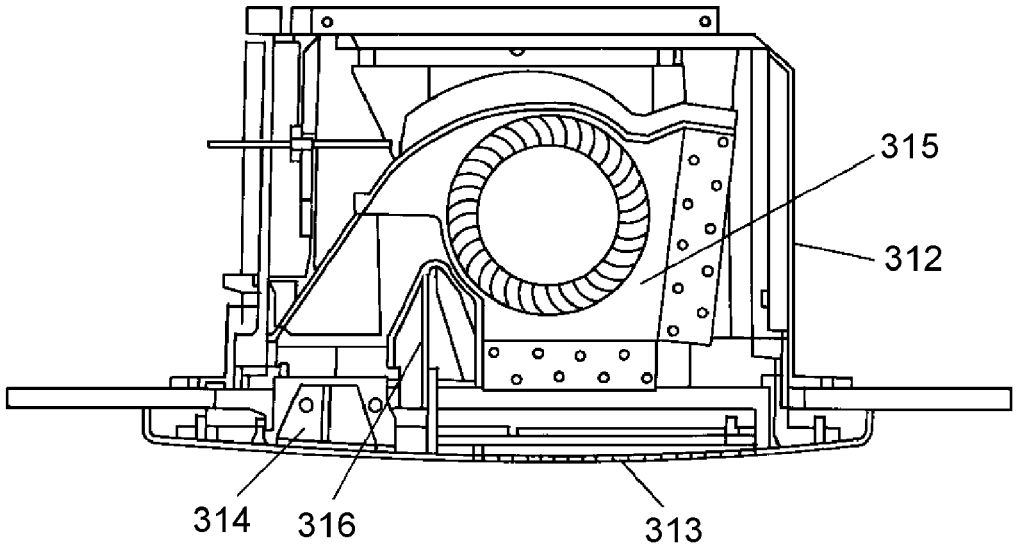
FIG. 29 PRIOR ART
FIG. 29 is a side configuration view illustrating a bathroom heating/drying device according to a fifth example of the known sauna device.
Figure 30:
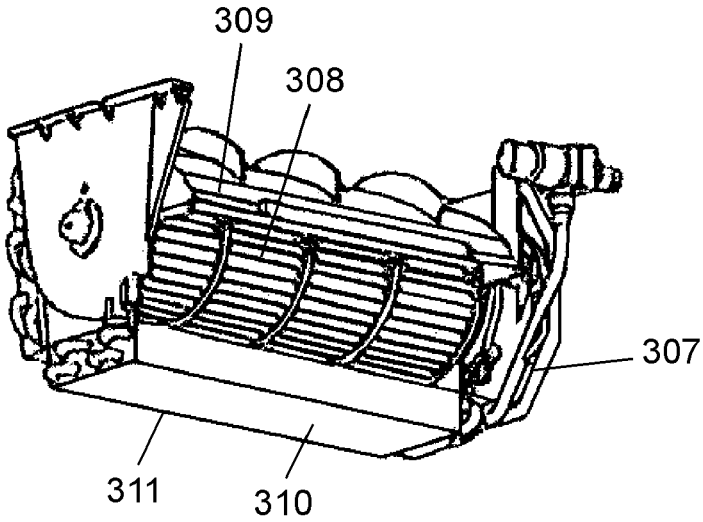
FIG. 30 PRIOR ART
FIG. 30 is a perspective view illustrating a circulation unit of the bathroom heating/drying device according to the fifth example of the known sauna device.

As shown in FIG. 24, humidifying unit 72 is provided with nozzle 73 for injecting water and water breakup section 75, which includes nozzle 73 and injection-water impact surface 74, for humidifying air by impacting the water injected from nozzle 73 on injection-water impact surface 74. Vapor-liquid separation unit 78 for separating large droplets and micro droplets is provided on the leeward of water breakup portion 75. A predetermined size of droplets collected by vapor-liquid separation unit 78 is 10 μm or more. Nozzle supply pipe 76 for supplying water to nozzle 73 is provided to be heated by water heating section 77.

The collected large droplets are introduced into drain outlet 79 through reservoir section 83 which is formed on the lower part of vapor-liquid separation unit 78 to store fallen water. Reservoir section 83 is provided outside of air flow passage 81 of humidifying-unit ventilation flue 80. Overflow sensing portion 82 for sensing overflow stream of reservoir section 83 is provided outside of air flow passage 81 of reservoir section 83.

In the configuration, humidifying unit 72 is provided with water breakup section 75 for humidifying air by impacting the water injected from nozzle 73 on injection-water impact surface 74. Therefore, the injected droplets are micronized by a strength of impact caused by injection from nozzle 73 and wall surface impact, and become droplets having a size at which the droplets are easily vaporized, and the droplets micronized by water breakup section 75 are generated. Hence, humidification amount increases, and start temperature rapidly increases.

Water heating section 77 is configured to be provided on the upstream side of nozzle 73. Therefore, cold water supplied to nozzle can be heated by exchanging heat with hot water flowing through water heating section 77, and hot water can be injected from nozzle 73. Thereby, it is possible to increase a humidification amount and a heat amount, and thus it is possible to shorten a starting time of the sauna device.

Vapor-liquid separation unit 78 for separating large droplets and micro droplets is provided on the leeward of water breakup portion 75. Therefore, the large droplets in the humidified air, in which large droplets and micro droplets entering into vapor-liquid separation unit 78 are mixed, are collected by impacting on a wall surface or an end face of vapor-liquid separation unit 78. On the other hand, micro droplets pass through the wall surface or the end face of vapor-liquid separation unit 78 without impact, and the blown humidified air includes only micro droplets. The inside of sauna room 51 can be turned into a clear and high-humidity space by the humidified air containing the blown micro droplets. Therefore, it is possible to create a sauna space having advantages that restriction in action caused by driving the sauna device is small while humid feeling is obtained, a user can read a book, and so on.

The size of droplets to be collected by vapor-liquid separation unit 78 is configured to be 10 μm or more. Therefore, a user can not feel droplet adhesion, and can use the device for a long time.

The collected large droplets are introduced into drain outlet 79 through reservoir section 83 which is formed on the lower part of vapor-liquid separation unit 78 to store fallen water. Therefore, the large droplets impacting on the end face or the wall surface of vapor-liquid separation unit 78 fall, are introduced into reservoir section 83 installed on the lower side. Meanwhile, since reservoir section 83 has drain outlet 79, the stored water can be drained from drain outlet 22 to the outside. Accordingly, the collected large droplets do not pool in ventilation flue 61 and are discharged to the outside, and thus mould, bacteria, and the like hardly occurs.

Reservoir section 83 is provided outside of air flow passage 81 of humidifying-unit ventilation flue 80. Overflow sensing portion 82 for sensing overflow stream of reservoir section 83 is provided outside of air flow passage 81 of reservoir section 83. Reservoir capacity can be kept at a constant level or a certain level or less, and overflow sensing portion 82 is disposed in reservoir section 83 out of the air flow passage out of humidifying-unit air circulation duct. Hence, a surface of the stored water is hardly waved, and it is possible to sense a water level with high precision. Thereby, it is possible to suppress overflow stream in the device.

INDUSTRIAL APPLICABILITY

In the coldest section in Hokkaido, humidification is essential during winter heating. Thus, by properly setting control temperature and humidity, the device is also applicable to an air-conditioning device integrally formed of a heating device and a humidifying device.

The invention claimed is:

1. A sauna device comprising:

a heating/humidifying unit for heating/humidifying air;

a ventilating unit for exhausting the air in the sauna room; and a control unit for controlling the heating/humidifying unit and the ventilating unit, wherein the heating/humidifying unit has a heating section for heating the air through a circulation blowing section for circulating the air in the sauna room and a humidifying section for humidifying the heated air having passed through the heating section, and the humidified air is blown out into the sauna room through the humidifying section, wherein the humidifying section has a suction inlet capable of suctioning water from the outside.

2. The sauna device of claim 1, wherein the humidifying section has a nozzle for injecting water and an injection-water impact surface as a water breakup portion, and air is humidified by impacting the water injected from the nozzle on a wall surface as the injection-water impact surface.

3. The sauna device of claim 2, wherein a nozzle supply pipe for supplying water to the nozzle is heated in a heated space by the heating section.

4. The sauna device of claim 2, wherein a vapor-liquid separation unit for separating large droplets having a predetermined size or more and micro droplets is provided on the leeward of the water breakup portion.

5. The sauna device of claim 4, wherein the large droplets are separated and collected, and are introduced into a drain outlet through a reservoir section which is formed on the lower part of the vapor-liquid separation unit to store fallen water.

6. The sauna device of claim 5, wherein the reservoir section has an outer airflow-passage reservoir portion located outside of a humidifying-section air circulation duct configured to interconnect the heating section and the humidifying section, and has an overflow sensing portion located on the outer airflow-passage reservoir portion.

7. The sauna device of claim 1, wherein a stopper for blocking the suction inlet is provided.

8. The sauna device of claim 1, wherein the heating section uses an electric heater, and the electric heater is disposed to have a certain angle with respect to a humidifying-section air circulation duct configured to interconnect the heating section and the humidifying section.

9. The sauna device of claim 1, wherein an air-blowing duct for passing humidified air having passed through the humidifying section has a bent portion.

10. The sauna device of claim 9, wherein the bent portion on an air duct wall forming the air-blowing duct is not continuous.

11. The sauna device of claim 9, wherein the bent portion is connected in a rectilinear shape in a section of the wall of the bent portion.

12. The sauna device of claim 11, wherein a sound-absorbing material is attached to the bent portion.

13. The sauna device of claim 9, wherein a droplet collection portion is provided on the bent portion.

14. The sauna device of claim 11, wherein a droplet collection portion is provided on the bent portion.

15. The sauna device of claim 9, wherein the air-blowing duct is formed in a substantially S shape.

16. The sauna device of claim 11, wherein the air-blowing duct is formed in a substantially S shape.

17. The sauna device of claim 13, wherein the air-blowing duct is formed in a substantially S shape.

18. The sauna device of claim 15, wherein a wind-direction changing plate is provided in the vicinity of an opening of a blowing port of a posterior border having a substantially inverse-S shape in the air-blowing duct.

19. The sauna device of claim 16, wherein a wind-direction changing plate is provided in the vicinity of an opening of a blowing port of a posterior border having a substantially inverse-S shape in the air-blowing duct.

20. The sauna device of claim 18, wherein the wind-direction changing plate has a shape wider than the air-blowing duct.

21. The sauna device of claim 19, wherein the wind-direction changing plate has a shape wider than the air-blowing duct.

22. The sauna device of claim 18, wherein the wind-direction changing plate is provided with a wing.

23. The sauna device of claim 19, wherein the wind-direction changing plate is provided with a wing.

24. The sauna device of claim 1, wherein an air-blowing duct for passing humidified air having passed through the humidifying section has a bent portion, and a rib provided on an outer periphery of the bent portion for permitting removal of moisture.

* * * * *